US009578968B2

(12) United States Patent
Masunaga et al.

(10) Patent No.: US 9,578,968 B2
(45) Date of Patent: Feb. 28, 2017

(54) CHAIR

(71) Applicant: OKAMURA CORPORATION, Yokohama-shi, Kanagawa (JP)

(72) Inventors: Hiroshi Masunaga, Yokohama (JP); Ryo Igarashi, Yokohama (JP); Syouichi Izawa, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 0 days.

(21) Appl. No.: 14/436,873

(22) PCT Filed: Apr. 25, 2013

(86) PCT No.: PCT/JP2013/062245

§ 371 (c)(1),
(2) Date: Apr. 17, 2015

(87) PCT Pub. No.: WO2014/061299

PCT Pub. Date: Apr. 24, 2014

(65) Prior Publication Data

US 2016/0100691 A1 Apr. 14, 2016

(30) Foreign Application Priority Data

Oct. 18, 2012 (JP) ..... 2012-230928
Oct. 18, 2012 (JP) ..... 2012-230929
Oct. 18, 2012 (JP) ..... 2012-230930

(51) Int. Cl.
*A47C 7/44* (2006.01)
*A47C 7/40* (2006.01)
(Continued)

(52) U.S. Cl.
CPC ..... *A47C 7/44* (2013.01); *A47C 1/03277* (2013.01); *A47C 7/40* (2013.01); *A47C 7/46* (2013.01); *A47C 7/462* (2013.01)

(58) Field of Classification Search
CPC ..... A47C 1/03255; A47C 7/14; A47C 7/44; A47C 7/46; A47C 1/03244; A47C 7/40; A47C 7/462
See application file for complete search history.

(56) References Cited

U.S. PATENT DOCUMENTS 6,572,190 B2 * 6/2003 Koepke ..... A47C 1/03255 297/284.1
7,249,802 B2 7/2007 Schmitz et al.
(Continued)

FOREIGN PATENT DOCUMENTS

CN 201032942 Y 3/2008
CN 101233978 A 8/2008
(Continued)

OTHER PUBLICATIONS

CN office action mailed Jul. 14, 2015 for Application No. 201380000511.7. (13 pages).
(Continued)

*Primary Examiner* — Philip Gabler
(74) *Attorney, Agent, or Firm* — Nixon Peabody, LLP; Khaled Shami

(57) ABSTRACT

A chair includes: a leg body; a backrest supporting body supported by the leg body; a backrest rear supporting member supported by the backrest supporting body; and a backrest that is supported by the backrest rear supporting member and supports the back of a user. The backrest has: a flexible upholstering material configured to receive the back of the user and is displaceable depending on the back; and a pair of vertical frame sections that are mounted on the upholstering material, have lower ends connected to the back rest rear section support section, and are separated in a width direction in which twisting deformation is allowed depending on a force applied from the upholstering material.

17 Claims, 29 Drawing Sheets

(51) Int. Cl.
*A47C 7/46* (2006.01)
*A47C 1/032* (2006.01)

(56) References Cited

U.S. PATENT DOCUMENTS

| | | | | |
|---|---|---|---|---|
| 7,712,833 | B2 * | 5/2010 | Ueda | A47C 1/03255 297/296 |
| 8,029,060 | B2 * | 10/2011 | Parker | A47C 1/023 297/300.1 |
| 8,096,615 | B2 * | 1/2012 | Parker | A47C 1/023 297/284.3 |
| 8,251,448 | B2 * | 8/2012 | Machael | A47C 7/14 297/299 |
| 2002/0005658 | A1 | 1/2002 | Piretti | |

FOREIGN PATENT DOCUMENTS

| | | | |
|---|---|---|---|
| CN | 201414597 | Y | 3/2010 |
| JP | 2008506486 | A | 3/2008 |
| JP | 4149755 | B | 9/2008 |
| JP | 2009112729 | A | 5/2009 |
| WO | 2011157392 | A1 | 12/2011 |

OTHER PUBLICATIONS

Search Report issued in CN Patent Application No. 201380000511.7 dated Dec. 31, 2015, 11 pages.
International Search Report for PCT Application No. PCT/JP2013/062245 mailed Jul. 30, 2013.

* cited by examiner

CHAIR

CROSS-REFERENCE TO RELATED PATENT APPLICATIONS

The present application is a National Stage Application of International Application No. PCT/JP2013/062245 entitled "CHAIR" filed Apr. 25, 2013, which claims priority of Japanese Patent Applications Nos. 2012-230928, 2012-230929 and 2012-230930, filed on Oct. 18, 2012, the contents of each are incorporated herein by reference in their entirety.

TECHNICAL FIELD

The present invention relates to a chair.

BACKGROUND ART

A chair is basically made up of a leg body, a seat section that is provided at an upper portion of the leg body, and a back section that supports a user who sits on the seat section. Chairs with various constitutions are generally known.

For example, as a support structure of the back section of the chair, one having a back member and arms that extend upward from a leg body and support portions separated on a back surface of the back member in a width direction from behind is proposed (see Patent Document 1 below).

A chair having a backrest and carrier members supporting respective upper and lower ends in approximately the middle of the backrest in a width direction is also proposed (see Patent Document 2 below).

In the chair, the backrest supported by the carrier members can reliably support the back of a user.

As the back section of the chair, one equipped with a back frame that is supported by a backrest support rod extending from a leg body backward and upward, has an upper frame and a lower frame and is formed in an approximately pentagonal shape when viewed from the front, and an elastically deformable net member that is arranged in the back frame is proposed (see Patent Document 3 below).

In addition, one equipped with a backrest having a back frame including an upper frame section, a lower frame section, a left frame section, and a right frame section and a back plate that is provided on the inside of the back frame, and a back strut supporting the left and right frame sections of the backrest from behind is also proposed (see Patent Document 4 below).

CITATION LIST

Patent Document

Patent Document 1
U.S. Pat. No. 7,249,802
Patent Document 2
Published Japanese Translation No. 2008-506486 of the PCT International Publication
Patent Document 3
Japanese Patent No. 4149755
Patent Document 4
Japanese Unexamined Patent Application, First Publication No. 2009-112729

SUMMARY OF INVENTION

Technical Problem

Here, in the chair described in Patent Document 1 above, when the user takes a posture of looking back from one side of the back member in the width direction to a rear side, a portion located farther outward in the width direction than a portion supported by the arm at the one side of the back member in the width direction is bent backward. However, the other side is not changed in the back member relative to the portion supported by the arm at the one side in the width direction, and thus there is a problem that an amount of deformation of the entire back member is limited and it is difficult to cause the deformation for the chair to conform a change in the user's position when the user takes the posture of the chair user looking back.

On the other hand, when a thickness of the back member is reduced for easy deformation, the back member is short of strength, and it is difficult to reliably support the user.

In addition, in the constitution described in Patent Document 1 above, even though a backward force from the user is applied to the back member, the back member is reliably supported by an axial force of the arms, deformation of the back member in an out-of-plane direction is suppressed. Accordingly, even though the user reclines their back backward, it is difficult to cause the deformation so as to greatly recline the back of the user backward.

In the chair described in Patent Document 2 above, when the user takes a posture of looking back from one side of the backrest in the width direction to the rear side, the backrest at the one side in the width direction varies to be bent backward. However, the backrest is supported by the carrier member in approximately the middle thereof in the width direction, and thus there is a problem in that the backrest at the other side in the width direction relative to the supported portion is not deformed and it is difficult to cause the deformation for the chair to conform a change in the user's posture.

Also, in the constitution described in Patent Document 3 above, the back frame is firmly configured to receive the back of the user, and thus an amount of deformation of the back frame in an out-of-plane direction is limited. Accordingly, deformation of the net member supported by the back frame in the out-of-plane direction is allowed depending on flexibility of the net member that is separated from the back frame, and is limited in the vicinity of an edge fixed to the back frame. For this reason, there is a problem in that it is difficult to cause the deformation conforming a shape of the back of the user.

In addition, in the constitution described in Patent Document 4 above, since the back strut supports the left frame section and the right frame section, even though a backward force from the user is applied to the back plate, deformation of the left and right frame sections is restrained, and deformation of the back plate installed on the left and right frame sections is also restrained. Accordingly, even though the user reclines their back backward, it is difficult to cause the deformation so as to greatly recline the back of the user backward. For this reason, in the chairs as described in Patent Documents 1 and 2, as the user cannot deeply recline without limitation and remain seated in the chair, there is a problem in which the chair does not change along with the user's posture.

The present invention has been made keeping in mind the above situations and provides a chair capable of reliably supporting the back of a user and, when the user takes a posture of looking back from one side in a width direction to a rear side, conforming a change in the user's position. The present invention further provides a chair capable of supporting the load of a user and being deformed conforming the shape of the back of the user or, when the user reclines their back backward, conforming their motion.

Solution to Problem

To achieve the object, the present invention employs the following means.

That is, a chair according to the present invention includes: a leg body; a backrest supporting body supported by the leg body; a backrest rear supporting member supported by the backrest supporting body; and a backrest supported by the backrest rear supporting member and configured to support a back of a user. The backrest has: a flexible upholstering material configured to receive the back of the user and enables displacement depending on the shape of the back; and a pair of vertical frame sections that are mounted on the upholstering material, have lower ends connected to the back rest rear section support section, and are separated in a width direction in which twisting deformation is allowed depending on a force applied from the back of the user.

Also, the chair according to the present invention may have a flexible upholstering material that is deformable depending on the back; an upper frame section on which the upholstering material is mounted and which is connected to the backrest rear supporting member; and a pair of vertical frame sections which are connected to both ends of the upper frame section in the width direction, on which the upholstering material is mounted, and which is elastically deformable depending on a force applied from the upholstering material.

Further, the backrest rear supporting member of the chair according to the present invention may have: a lower connection section that is connected to the backrest supporting body; a deformable section that extends upward from the lower connection section and is elastically deformable according to a load applied to the backrest from the back of the user; and an upper connection section that extends upward from an upper end of the deformable section and is connected to the backrest at an upper end thereof.

In the chair configured in this way, when the user sits down on the seat and the back of the user is received by the upholstering material of the backrest, a load of the user is transmitted from the upholstering material to the upper frame section and the pair of vertical frame section. Since the vertical frame section or the upper frame section is connected to and supported by the backrest rear supporting member supported by the backrest supporting body, the load from the user can be reliably supported by the vertical frame section, the backrest rear supporting member, and the backrest supporting body.

On the other hand, when the user 1 takes a posture of looking back from one side in the width direction to a rear side, the load from the user is biased and applied to the one side of the backrest in the width direction, and a load causing twisting deformation of the vertical frame section is applied to the vertical frame section of the biased side. Accordingly, the vertical frame section can subjected to twisting deformation to the rear lateral side incline the supported backrest backward.

Also, since the backrest is configured by the upholstering material, the backrest can be inclined to a rear lateral side and conform the deformation of the position of the back of the user.

On the other hand, since the pair of vertical frame sections connected to both of the ends of the upper frame section in the width direction are elastically deformed by the force applied from the upholstering material, the vertical frame sections can be deformed to conform the shape of the back of the user according to the load of the user and receive the back so as to wrap around the back along with the upholstering material. For this reason, the user can sits down on the seat in a stable state.

Also, when a load is applied backward to the backrest from the user, the load of the user is transmitted to the backrest rear supporting member supporting the backrest. In this case, the deformable section of the backrest rear supporting member which is interposed between the lower connection section connected to the backrest supporting body and the upper connection section connected to the backrest is elastically deformed to be gradually inclined backward toward the upper side. Along with the deformation of the deformable section, the backrest supported by the backrest rear supporting member allows the backrest to be greatly inclined backwards In addition, the upper connection section is provided above the deformable section inclined backward. Accordingly, as the deformable section is inclined backward, the upper connection section can move backward while keeping an upper end connected to the backrest. Therefore, when the load of the user is applied in a direction in which it reclines the backrest backward, the backrest can be inclined backward by conforming a motion of reclining the backrest.

Also, the backrest rear supporting member of the chair according to the present invention preferably has a pair of connection segments that are mutually separated outward from the middle in the width direction toward an upper side from a lower side, have upper ends connected to the pair of vertical frame sections, and enable displacement along with twist of the vertical frame sections. The vertical frame section of the chair according to the present invention preferably has a lower material that is inclined to tilt forward toward the upper side and an upper material that is connected to the lower material and enables twisting deformation with a force applied from the back of the user.

In the chair configured in this way, when the load from the user is transmitted from the upholstering material of the backrest to the pair of vertical frame sections, the vertical frame sections are subjected to twisting deformation. The pair of connection segments connected to the vertical frame sections are displaced along with the twisting deformation of the vertical frame sections. Accordingly, when user takes the posture of looking back from the one side in the width direction to the rear side, as the vertical frame section of the one side is twisted and deformed backward, and the pair of connection segments can move to the rear lateral side while keeping the upper ends thereof connected to the vertical frame sections. Accordingly, the vertical frame sections can receive the back so as to wrap around the back along with the upholstering material, and thus stably support the back and shoulders of the user in a state in which they conform to the shapes of the back and shoulders of the user. In addition, in the chair configured in this way, since the upper material is elastically deformed by the force applied from the upholstering material, the upper material can be deformed to conform to the back of the user according to the load of the user and receive the user's back so as to wrap around the user's back along with the upholstering material. On the other hand, the lower material can reliably support, for instance, the circumference of the waist at a lower side relative to the back of the user along with the upholstering material.

Also, the pair of vertical frame sections of the chair according to the present invention may each have a lower material that is inclined to tilt forward toward the upper side and an upper material that is connected to the lower material and enables twisting deformation with a force applied from the back of the user.

In the chair configured in this way, since the lower material can reliably support, for instance, the circumference of the waist at a lower side relative to the back of the user along with the upholstering material, and since the upper material is subjected to twisting deformation by the force applied from the back of the user, the lower and upper materials can be deformed to conform the back of the user according to the load of the user and receive the back so as to wrap around the back along with the upholstering material. Accordingly, when the user takes the posture of looking back from the one side in the width direction to the rear side is taken, the lower material supports the circumference of the waist of the user along with the upholstering material, and in the meantime the upper material can be subjected to the twisting deformation and stably support the back and shoulders of the user in the state in which it conforms the shapes of the back and shoulders of the user.

Also, the vertical frame sections of the chair according to the present invention may be curved to become convex forward, and the backrest rear supporting member may be curved to become convex backward.

In the chair configured in this way, since the vertical frame sections are curved to become convex forward, deformation of the vertical frame sections can be suppressed in a forward/backward direction and reliably receive the load of the user. Also, the vertical frame sections can be deformed in the width direction so as to conform the shape of the back of the user and receive the back so as to wrap around the back. Accordingly, when user takes the posture of looking back from the one side in the width direction to the rear side, the vertical frame section can be deformed and receive the user's back so as to wrap around the user's back along with the upholstering material, and thus stably support the back and shoulders of the user in the state in which it conform the deformation.

Also, in the chair configured in this way, since the backrest rear supporting member is curved to become convex backward, an upper portion of the backrest rear supporting member can reliably support a load applied backward from the user by suppressing deformation in the forward/backward direction with its own axial force.

Also, the backrest rear supporting member of the chair according to the present invention may have upper connection sections that are disposed to be gradually widened outside in the width direction toward the upper side and support both ends of the upper frame section in the width direction.

In the chair configured in this way, the upper frame section is supported by the upper connection sections disposed such that both ends thereof are gradually widened outside in the width direction toward the upper side. Thereby, deformation in the forward/backward direction can be suppressed and can reliably and stably support upper portions, for instance, around the shoulders of the user.

Also, the backrest rear supporting member and the vertical frame section of the chair according to the present invention may be integrally formed in an annular shape when viewed from the side.

In the chair configured in this way, the effects described above can be obtained, and the backrest rear supporting member and the vertical frame section are integrally formed, and thereby a robust structure can be made and excellent designability in which they are formed in the annular shape can be attained.

Also, in the chair according to the present invention, the backrest rear supporting member may have: a lower connection section that is connected to the backrest supporting body; and a deformable section that extends upward from the lower connection section and enables elastic deformation according to a load applied from the back of the user to the backrest, and the upper connection sections may be formed in a V shape so as to be separated from each other toward the upper side from an upper end of the deformable section and be configured as a pair of connection segments having upper ends connected to the vertical frame section. The lower connection section, the deformable section, one of the pair of connection segments, and one of the pair of vertical frame sections may constitute a first annular section having an annular shape when viewed from the side, and the lower connection section, the deformable section, the other of the pair of connection segments, and the other of the pair of vertical frame sections may constitute a second annular section having an annular shape when viewed from the side. The first annular section and the second annular section may be connected by the lower connection section and the deformable section and be integrally formed.

In the chair configured in this way, the lower connection section, the deformable section, the pair of connection segments, and the pair of vertical frame sections are integrally formed. Thereby, a robust structure can be made and very excellent designability can be attained.

In addition, when a load is applied to the backrest from the user, the load of the user is transmitted to the backrest rear supporting member supporting the backrest. In this case, the deformable section of the backrest rear supporting member which is interposed between the lower connection section connected to the backrest supporting body and the upper connection section connected to the backrest is elastically deformed. Along with the deformation of the deformable section, the backrest supported by the backrest rear supporting member allow a position thereof to be greatly inclined backward.

Also, the upper connection section of the chair according to the present invention is preferably formed to be gradually inclined forward toward the upper side.

In the chair configured in this way, since the upper connection section is formed to be gradually inclined forward toward the upper side, the deformation of the upper connection section can be suppressed in the forward/backward direction and support the load of the user, and the backrest connected to the upper connection section can also reliably support the load of the user.

On the other hand, the deformable section is deformed. Thereby, the backrest connected to the lower and upper connection sections of the backrest rear supporting member can be inclined backward depending on the load of the user.

Also, the upper connection section of the chair according to the present invention may have a pair of connection segments that are connected with the deformable section at lower ends thereof, are formed in a V shape so as to be separated from each other toward the upper side, and have upper ends connected to the backrest.

In the chair configured in this way, the pair of connection segments has upper ends connected to the backrest. Thereby, a load applied to one side or the other side of the backrest from the user in the width direction can be reliably supported.

Also, the backrest of the chair according to the present invention may have: a lower material whose lower end is connected to the lower connection section and which is formed to be gradually inclined forward toward the upper side; and an upper material that is connected to the upper connection section at an upper end thereof.

In the chair configured in this way, since the lower material is inclined forward toward the upper side, the deformation of the lower material can be suppressed and support the load of the user. On the other hand, since the upper material is relatively inclined backward relative to the lower material toward the upper side, it can be conformed and inclined backward by backward inclination depending on the load of the user.

Here, the deformation of the lower material is suppressed, and the backrest connected to the backrest rear supporting member at upper and lower portions thereof is inclined within a range of the upper material in the upward/downward direction. Accordingly, when the backrest rear supporting member is inclined backward, the upper material is inclined at a greater inclined angle than the backrest rear supporting member.

For this reason, an amount of deformation of the deformable section of the backrest rear supporting member is suppressed to the minimum extent, and in the meantime the backrest can be greatly inclined backward and more effectively conform the motion of the back of the user. Accordingly, even when the deformation of the deformable section is repeated and moment is concentrated, there is no fear of damage or breakage.

Also, the backrest of the chair according to the present invention may have a flexible upholstering material whose lower portion is connected to the lower material, whose upper portion is connected to the upper material, which receives the back of the user, and which enables deformation depending on the back.

In the chair configured in this way, when the load is applied to the backrest from the user, the upholstering material of the backrest is deformed along the back of the user, and the deformable section of the backrest rear supporting member which supports the backrest is elastically deformed. Accordingly, when the load of the user is applied in a direction in which it reclines the backrest backward, the backrest can be inclined backward by conforming a motion of reclining the backrest and receive the back of the user so as to wrap around the back of the user in the state in which it is inclined backward.

Advantageous Effects of Invention

According to the chair according to the present invention, it is possible to reliably support the back of the user and, when the user takes a posture of looking back from one side in the width direction to a rear side, it is possible to conform a change in the user's position. Furthermore, it is possible to support the load of the user and, when the deformation is made conforming the change in the back position of the user and the user reclines their back backward, it is possible to conform the motion.

DESCRIPTION OF EMBODIMENTS

First Embodiment

Hereinafter, a chair according to a first embodiment of the present invention will be described with reference to the drawings.

Figure 1:
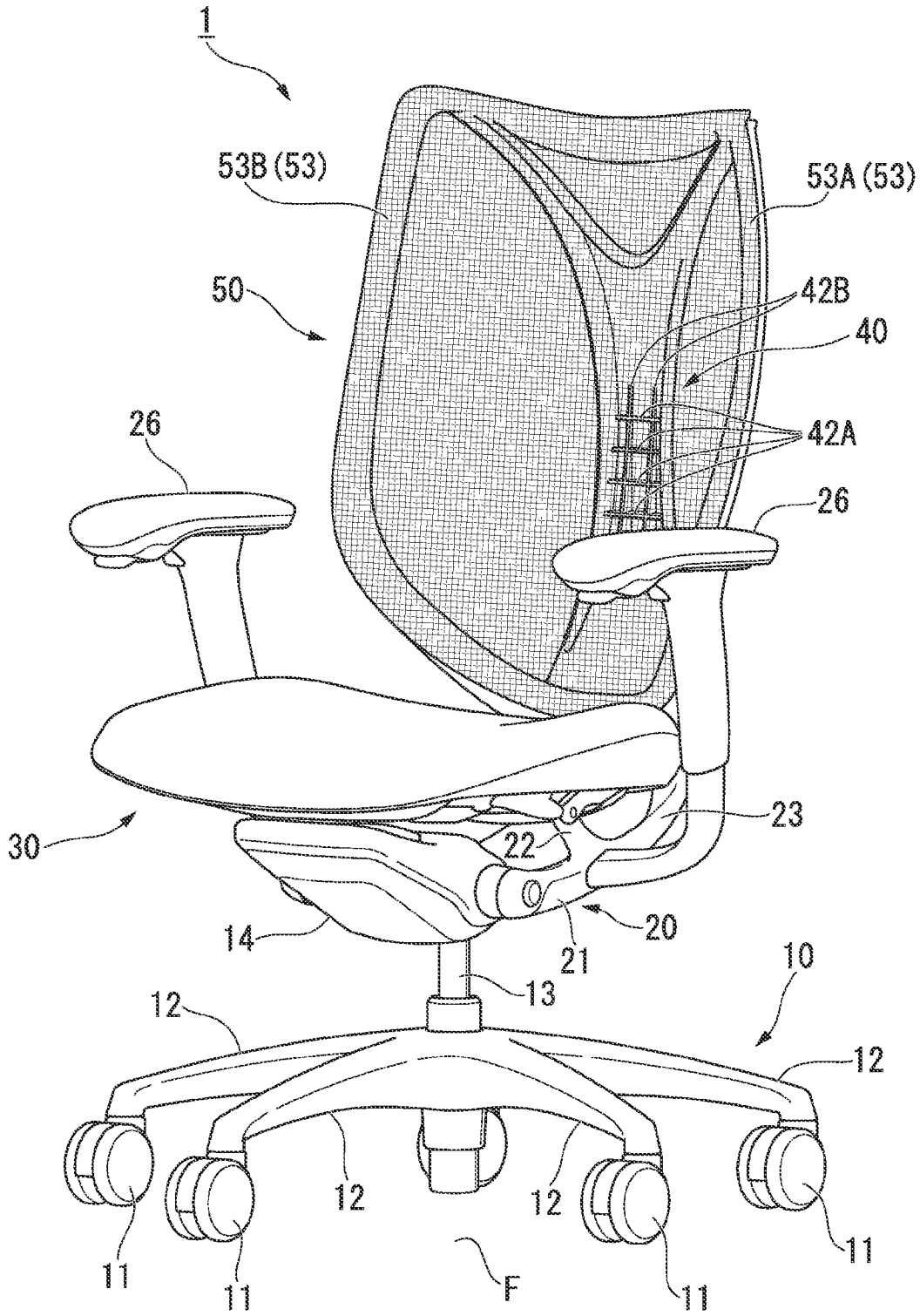
FIG. 1 is a perspective view of a chair according to a first embodiment of the present invention when viewed from the oblique front side.

As illustrated in FIG. 1, the chair 1 according to the present embodiment is equipped with a leg body 10 provided on a floor F, a backrest supporting body 20 supported by the leg body 10, a seat section 30 which is provided on the backrest supporting body 20 and on which a user can sit, a backrest rear supporting member 40 supported by the backrest supporting body 20, and a backrest 50 that is supported by the backrest rear supporting member 40 and supports the back of the user. Details of each component will be described below. In the following description, a direction in which the user sits down on the seat or rises from the seat is defined as a forward/backward direction, a side from which the user sits down on the seat is defined as a front side, and the opposite side is defined as a rear side. In addition, a direction that is perpendicular to the forward/backward direction within a horizontal plane is defined as a width direction, and sides that are separated from the chair in the width direction are defined as lateral sides.

Leg Body

The leg body 10 is equipped with a plurality of leg rods 12 for which casters 11 are swivelable on the floor F are provided and a leg column 13 supported by the plurality of leg rods 12. The plurality of leg rods 12 are radially disposed and connected to each other at base ends thereof, and the casters 11 are mounted on respective tips thereof.

The leg column 13 is connected to the base ends of the plurality of leg rods 12 at a lower portion thereof and is erected upward. A support base 14 in which a reclining mechanism (not shown) making it possible to tilt the backrest supporting body 20 backward is mounted on an upper portion of the leg column 13.

Backrest Supporting Body

The backrest supporting body 20 has a pair of forward arm sections 21 whose base portions are supported to be rotatable to both lateral sides of the support base 14 in a width direction, a pair of upward arm sections 22 that extend upward from the base portions of the forward arm sections 21 and support the seat section 30, and a pair of backward arm sections 23 that extend backward from the base portions of the forward arm sections 21.

Figure 2:
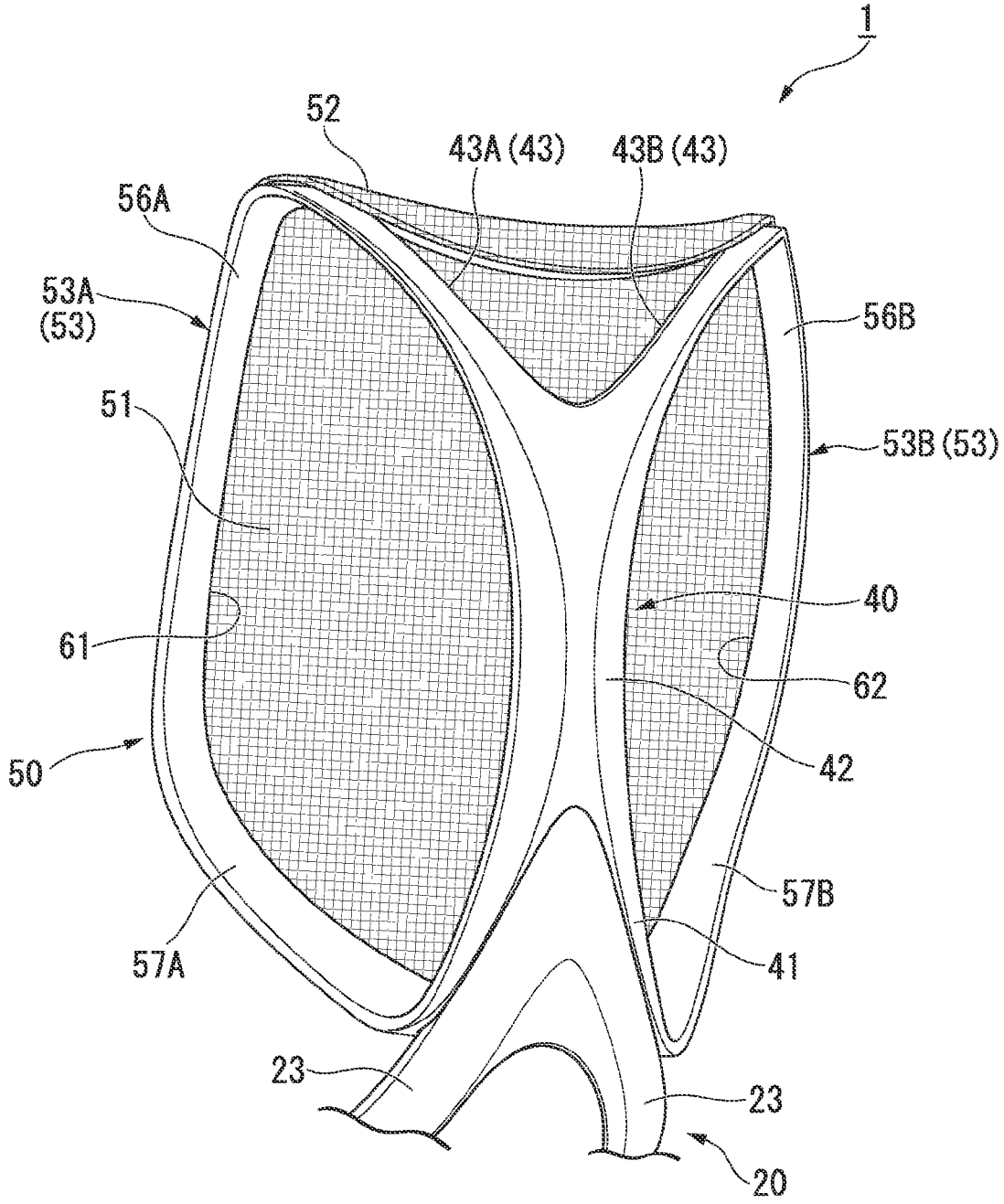
FIG. 2 is a perspective view of an upper portion of the chair according to the first embodiment of the present invention when viewed from the rear.

As illustrated in FIG. 2, the pair of backward arm sections 23 are disposed to gradually come close to each other toward the rear side and are connected to each other at rear ends thereof, thereby being disposed in a downward V shape as one body. The rear ends of the pair of backward arm sections 23 are fixed to a lower portion of the backrest rear supporting member 40 to be described below.

In addition, as illustrated in FIG. 1, the backrest supporting body 20 is provided with armrests 26 extending upward from the lateral sides thereof.

Seat Section

Figure 3A:
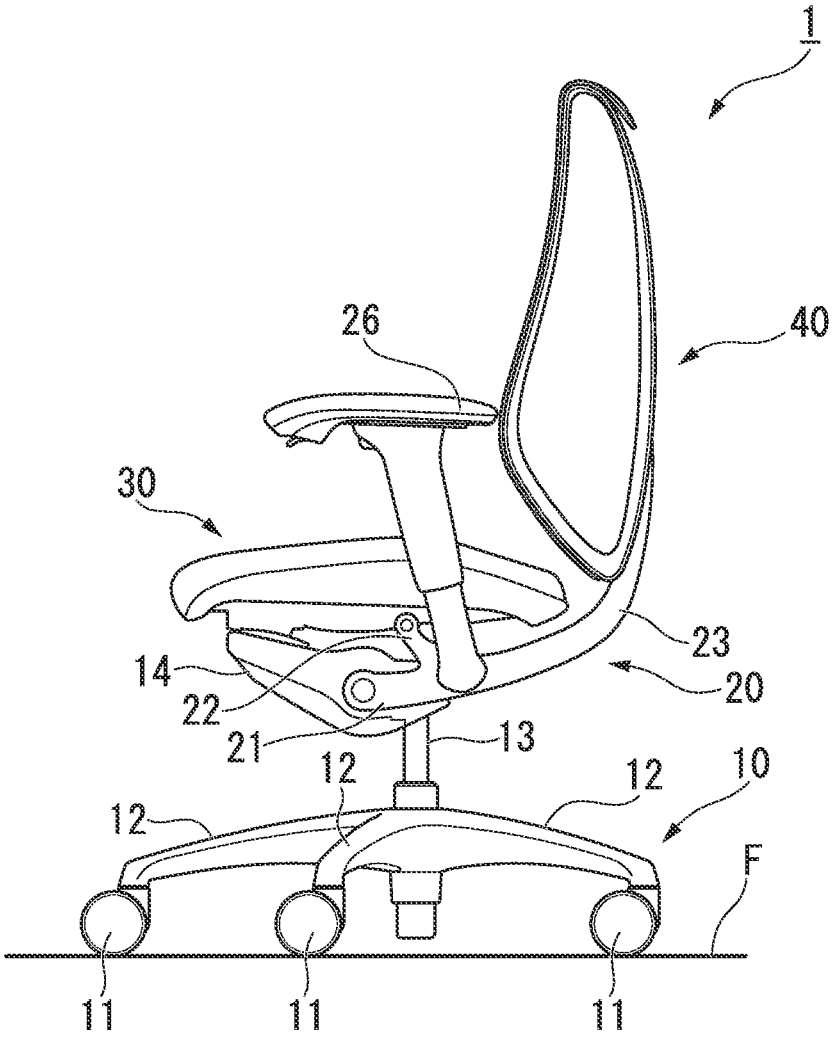
FIG. 3A is a side view of the chair according to the first embodiment of the present invention at normal times.
Figure 3B:
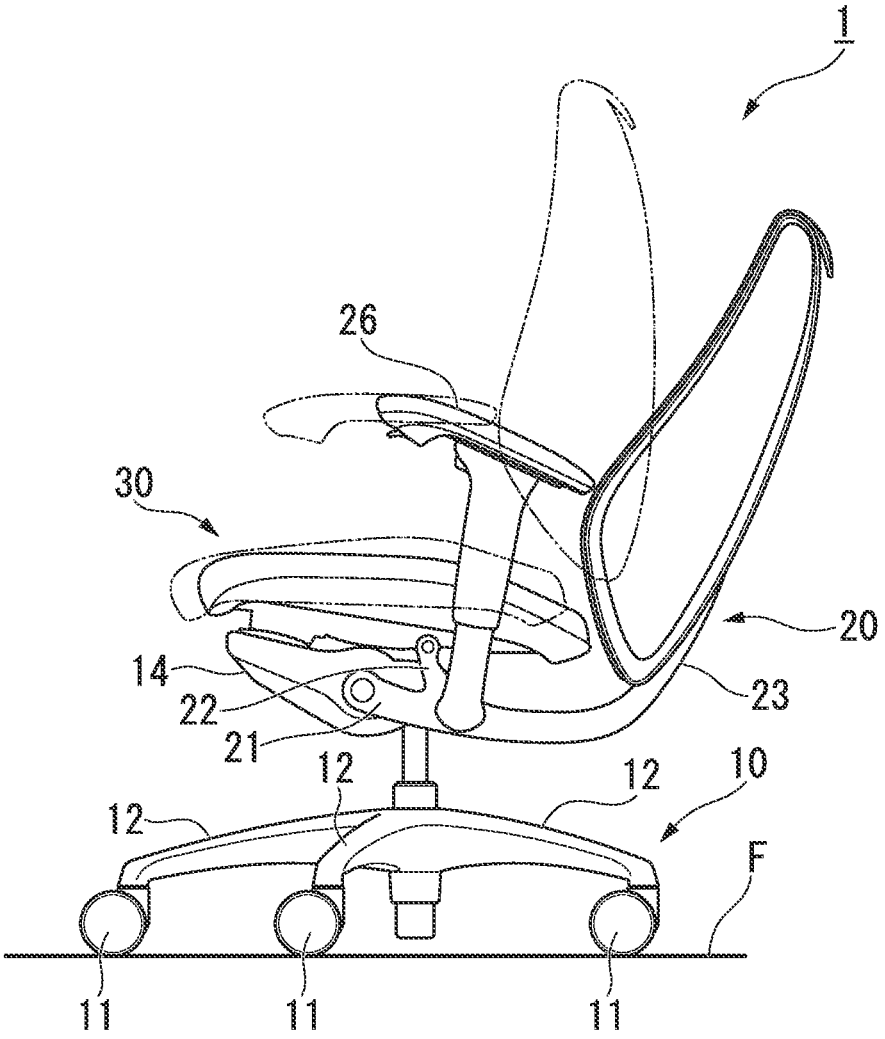
FIG. 3B is a side view of the chair according to the first embodiment of the present invention in a state in which a user is tilted on a backrest backward.

As illustrated in FIGS. 3A and 3B, the seat section 30 is supported such that a front portion thereof is slidable relative to the support base 14 in the forward/backward direction and is provided to be rotatable for the upward arm sections 22 of the backrest supporting body 20. As the backrest supporting body 20 is inclined backward by the reclining mechanism of the support base 14, the seat section 30 is configured to move backward relative to the support base 14 and to tilt the rear side downward.

Backrest Rear Supporting Member

As illustrated in FIG. 2, the backrest rear supporting member 40 has a lower connection section 41 connected to the backrest supporting body 20, a deformable section 42 extending upward from the lower connection section 41, and an upper connection section 43 disposed to be gradually widened outside in the width direction toward the upper side from an upper end of the deformable section 42.

The lower connection section 41 is formed with a recessed portion (not shown) in a lower rear surface thereof into which the pair of backward arm sections 23 of the backrest supporting body 20 are fitted. The pair of backward arm sections 23 are fitted into the recessed portion. Thus, the lower connection section 41 is fixed by, for instance, screwing nuts and bolts (not shown) onto an upper portion of the backrest supporting body 20 at the recessed portion. Further, the lower connection section 41 is connected to the backrest 50 at a lower end thereof.

Figure 4:
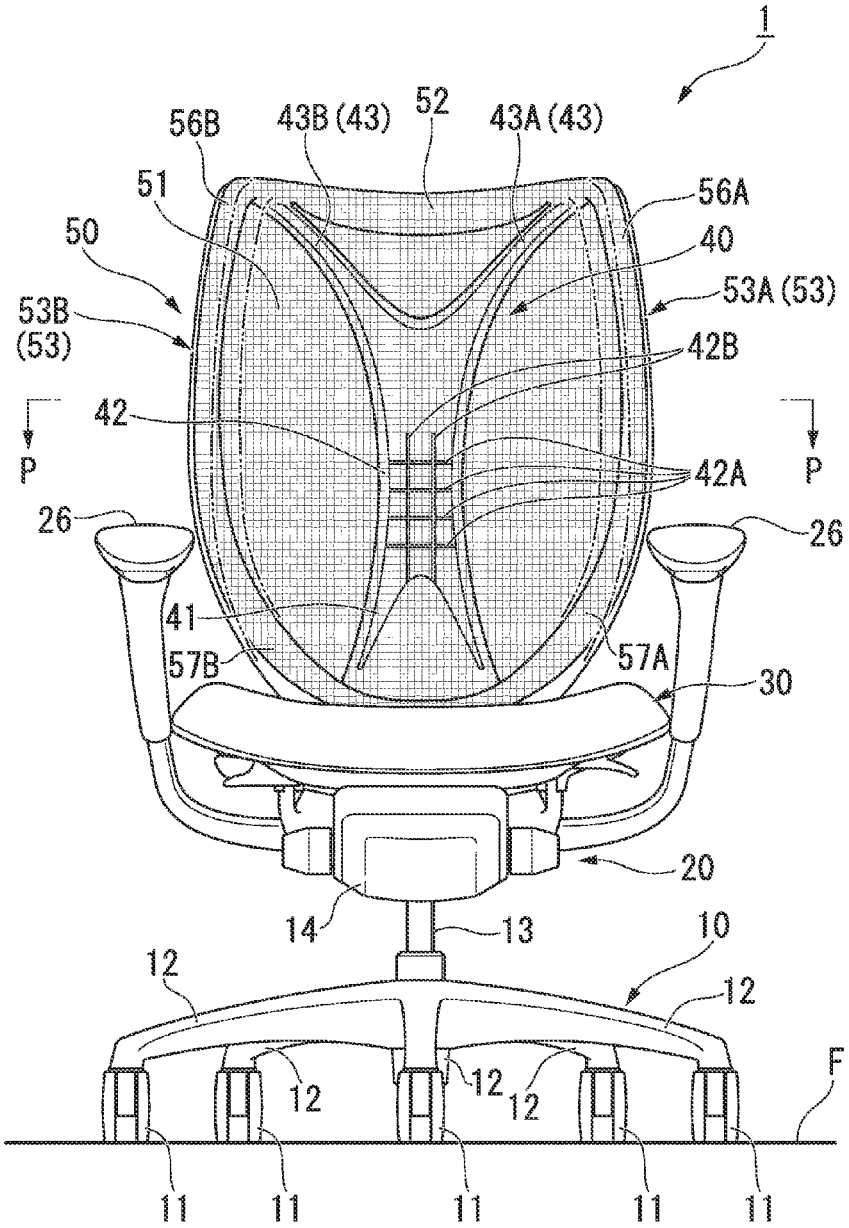
FIG. 4 is a perspective view of the chair according to the first embodiment of the present invention when viewed from the front.

As illustrated in FIGS. 1 and 4, the deformable section 42 is connected to the lower connection section 41 at a lower end thereof and is disposed upward. The deformable section 42 is also formed such that a length in the width direction is gradually narrowed toward the upper side and the length in the width direction is again increased halfway toward the upper side.

A horizontal cross section of the deformable section 42 whose front surface becomes a concave surface and whose rear surface becomes a convex surface is formed in a laterally-facing U-shaped. Thus, on the front surface of the deformable section 42 which is formed in the concave shape, a plurality of transverse ribs 42A that protrude forward and extend in an approximately horizontal direction are separated and formed in an upward/downward direction as well as a plurality of longitudinal ribs 42B that protrude forward and extend in an approximately vertical direction are separated and formed in the width direction of the chair 1.

In the present embodiment, four transverse ribs 42A are formed, and two longitudinal ribs 42B are formed to intersect these transverse ribs 42A. In the deformable section 42, in addition to the fact that the horizontal cross section is formed in the laterally-facing U-shaped, rigidity is enhanced by these transverse ribs 42A and longitudinal ribs 42B.

The upper connection section 43 is connected to the deformable section 42 at a lower end thereof and is disposed to be gradually widened outside in the width direction toward the upper side. In the present embodiment, the upper connection section 43 has a pair of connection segments 43A and 43B that are disposed to be gradually separated outside from each other in the width direction toward the upper side and is formed in a V shape as a whole by the pair of connection segments 43A and 43B.

The pair of connection segments 43A and 43B are configured to be displaceable along with the twisting of vertical frame sections 53A and 53B.

Figure 8:
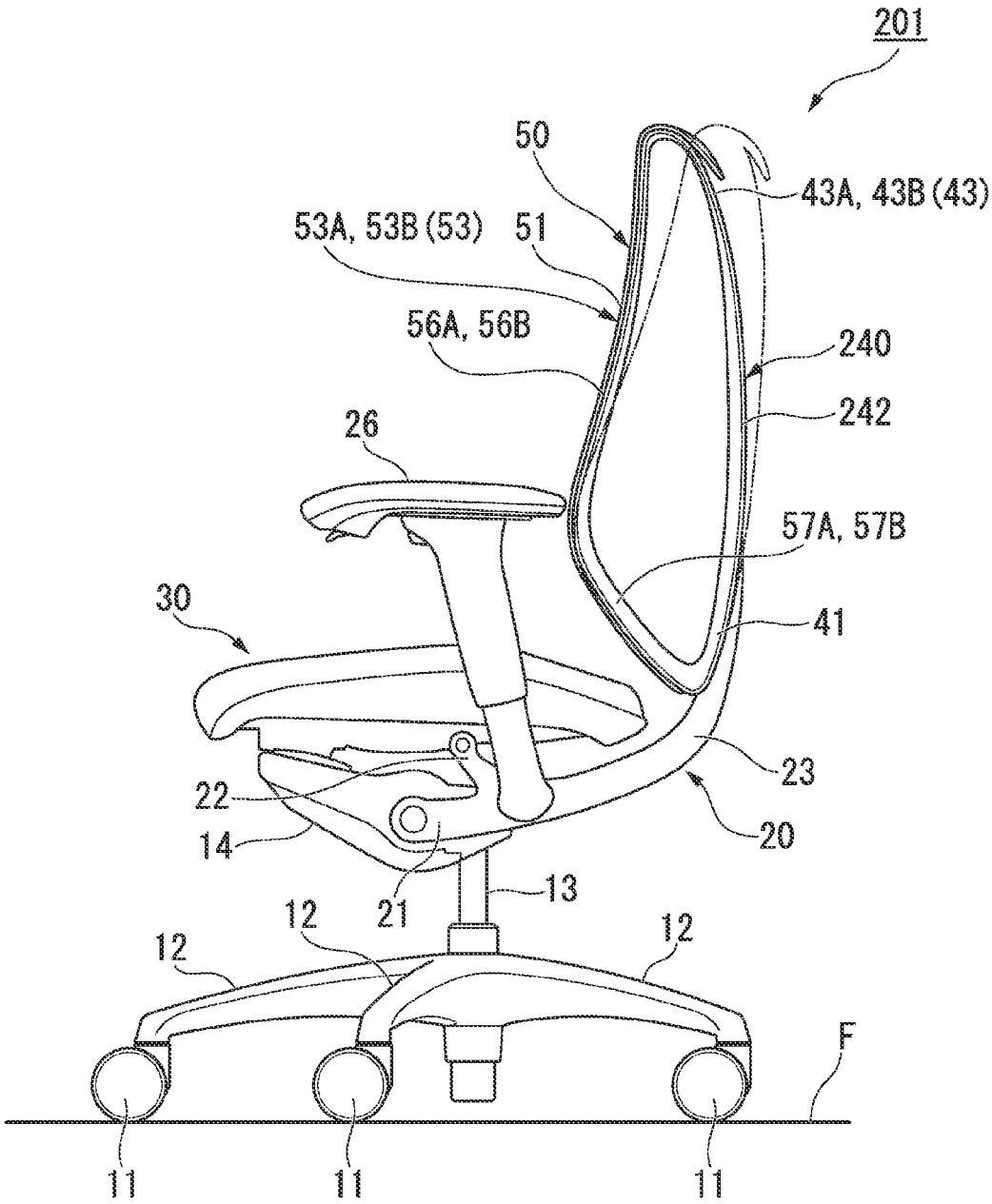
FIG. 8 is a side view of the chair according to the second embodiment of the present invention.

As illustrated in FIG. 8, the lower connection section 41, the deformable section 42, and the pair of connection segments 43A and 43B constituting the upper connection section 43 are integrally formed, and the backrest rear supporting member 40 are curved as a whole so as to become convex backward when viewed from the side.

That is, the lower connection section 41 is inclined to turn to the rear side toward the upper side as a whole while being curved. The pair of connection segments 43A and 43B constituting the upper connection section 43 are also inclined to turn to the front side toward the upper side while being curved. Thus, the deformable section 42 connects the upper connection section 43 and the lower connection section 41 while being curved.

Backrest

As illustrated in FIG. 2, the backrest 50 has an upholstering material 51 that receives the back of a user, an upper frame section 52 on which the upholstering material 51 is mounted and which is connected with the upper connection section 43 in the backrest rear supporting member 40, and a pair of vertical frame sections 53A and 53B (53) which are connected with the upper frame section 52, on which the upholstering material 51 is mounted, and which are separated in the width direction.

The upholstering material 51 receives the back of the user and is configured by a flexible member deformable depending on a posture of the user's back. To be specific, in the present embodiment, the upholstering material 51 is formed of a mesh-like material, and can be elastically bent and deformed as a whole as threads constituting a mesh are elastically expanded and contracted. The upholstering material 51 is provided for a portion surrounded by the upper frame section 52 and the pair of vertical frame section 53, and an end thereof is fixed by the upper frame section 52 and the pair of vertical frame sections 53.

The upper frame section 52 extends in the width direction, and both ends thereof are connected to the upper ends of the backrest rear supporting member 40 and are connected to upper ends of the pair of vertical frame sections 53A and 53B.

The vertical frame sections 53A and 53B are configured to enable twisting deformation together depending on a force applied from the back of the user. In addition, one vertical frame section 53A has a lower material 57A and an upper material 56A connected to an upper end of the lower material 57A. Similarly, the other vertical frame section 53B also has a lower material 57B and an upper material 56B connected to an upper end of the lower material 57B.

As illustrated in FIGS. 2 and 8, the lower materials 57A and 57B are connected to a lower end of the backrest rear supporting member 40 at lower ends thereof and are formed to be gradually spread in the forward direction and outside in the width direction toward the upper side. Each of the lower materials 57A and 57B is also formed such that a width of a cross section is reduced toward the upper side.

The upper materials 56A and 56B are configured to enable twisting deformation depending on a force applied from the back of the user and elastic deformation with the force applied from the back of the user.

The upper materials 56A and 56B are connected to the lower materials 57A and 57B corresponding thereto at lower ends thereof, connected to the upper frame section 52 and the pair of connection segments 43A and 43B of the backrest rear supporting member 40 at upper ends thereof, and formed to be inclined backward relative to the lower materials 57A and 57B toward the upper side.

In the present embodiment, the upper materials 56A and 56B are formed to be gradually inclined backward from the upper ends of the lower materials 57A and 57B toward the upper side.

In this way, the vertical frame sections 53A and 53B are formed by the lower materials 57A and 57B so as to gradually turn to the rear side toward the upper side from lower portions thereof and are formed by the upper materials 56A and 56B so as to gradually turn to the front side toward the upper side from connected portions of the lower materials 57A and 57B and the upper materials 56A and 56B. The vertical frame sections 53A and 53B are also curved to become convex forward as a whole.

Backrest Rear Supporting Member

As illustrated in FIG. 2, the backrest rear supporting member 40 has the lower connection section 41 connected to the backrest supporting body 20, the deformable section 42 extending upward from the lower connection section 41, and the upper connection section 43 disposed to be gradually widened outside in the width direction toward the upper side from the upper end of the deformable section 42.

The lower connection section 41 is formed with the recessed portion (not shown) in the lower rear surface thereof into which the pair of backward arm sections 23 of the backrest supporting body 20 are fitted. The pair of backward arm sections 23 are fitted into the recessed portion. The lower connection section 41 is fixed by, for instance, screwing bolts and nuts (not shown) onto the upper portion of the backrest supporting body 20 at the recessed portion. Further, the lower connection section 41 is connected to the lower materials 57A and 57B of the vertical frame sections 53A and 53B in the backrest 50 at the lower end thereof As illustrated in FIGS. 1 and 4, the deformable section 42 is connected to the lower connection section 41 at the lower end thereof, is disposed upward, and is connected to the upper connection section 43 at the upper end thereof. The deformable section 42 is also formed such that a length in the width direction is gradually reduced toward the upper side and the length in the width direction is again increased halfway toward the upper side.

A horizontal cross section of the deformable section 42 whose front surface becomes the concave surface and whose rear surface becomes the convex surface is formed in the laterally-facing U-shaped. On the front surface of the deformable section 42 which is formed in the concave shape, the plurality of transverse ribs 42A that protrude forward and extend in the approximately horizontal direction are separated and formed in the upward/downward direction as well as the plurality of longitudinal ribs 42B that protrude forward and extend in the approximately vertical direction are separated and formed in the width direction of the chair 1.

In the present embodiment, four transverse ribs 42A are formed, and two longitudinal ribs 42B are formed to intersect these transverse ribs 42A. In the deformable section 42, in addition to the fact that the horizontal cross section is formed in the laterally-facing U-shaped, the rigidity is enhanced by these transverse ribs 42A and longitudinal ribs 42B.

The upper connection section 43 is connected to the deformable section 42 at the lower end thereof and is formed to be gradually widened outside in the width direction toward the upper side and to be gradually inclined forward toward the upper side.

In the present embodiment, the upper connection section 43 has a pair of connection segments 43A and 43B which are disposed to be gradually separated outside from each other in the width direction toward the upper side and whose upper ends are connected to the upper materials 56A and 56B of the vertical frame sections 53A and 53B in the backrest 50, and is formed in the V shape as a whole by the pair of connection segments 43A and 43B.

The pair of connection segments 43A and 43B are configured to be displaceable along with the twisting of the vertical frame sections 53A and 53B.

The lower connection section 41, the deformable section 42, and the pair of connection segments 43A and 43B constituting the upper connection section 43 are integrally formed, and the backrest rear supporting member 40 are curved as a whole so as to become convex backward when viewed from the side.

That is, the lower connection section 41 is inclined to turn to the rear side toward the upper side as a whole while being curved. The pair of connection segments 43A and 43B constituting the upper connection section 43 are also inclined to turn to the front side toward the upper side while being curved. The deformable section 42 connects the upper connection section 43 and the lower connection section 41 while being curved.

As illustrated in FIG. 2, the backrest rear supporting member 40 and the vertical frame section 53 are integrally formed in an annular shape when viewed from the side. In the present embodiment, the lower connection section 41, the deformable section 42, and one connection segments 43A of the backrest rear supporting member 40 and the upper material 56A and the lower material 57A of one vertical frame section 53A constitute a first annular section 61 having an annular shape when viewed from the side.

In addition, a second annular section 62 having an annular shape when viewed from the side is configured by the lower connection section 41, the deformable section 42, and the other connection segments 43B of the backrest rear supporting member 40 and by the upper material 56B and the lower material 57B of the other vertical frame section 53B.

These first and second annular sections 61 and 62 are connected by the lower connection section 41 and the deformable section 42 and are integrally formed as a whole. The upper frame section 52 is also integrally formed to connect an upper end of each of the first and second annular sections 61 and 62.

That is, in the present embodiment, each section of the backrest rear supporting member 40 and the upper frame section 52 and the pair of vertical frame sections 53A and 53B of the, backrest 50 are integrally formed.

Next, a description will be made with reference to operations of the backrest rear supporting member 40 and the backrest 50 of the chair 1 when a user sits on the seat section 30 of the chair 1 configured as described above.

Figure 6A:
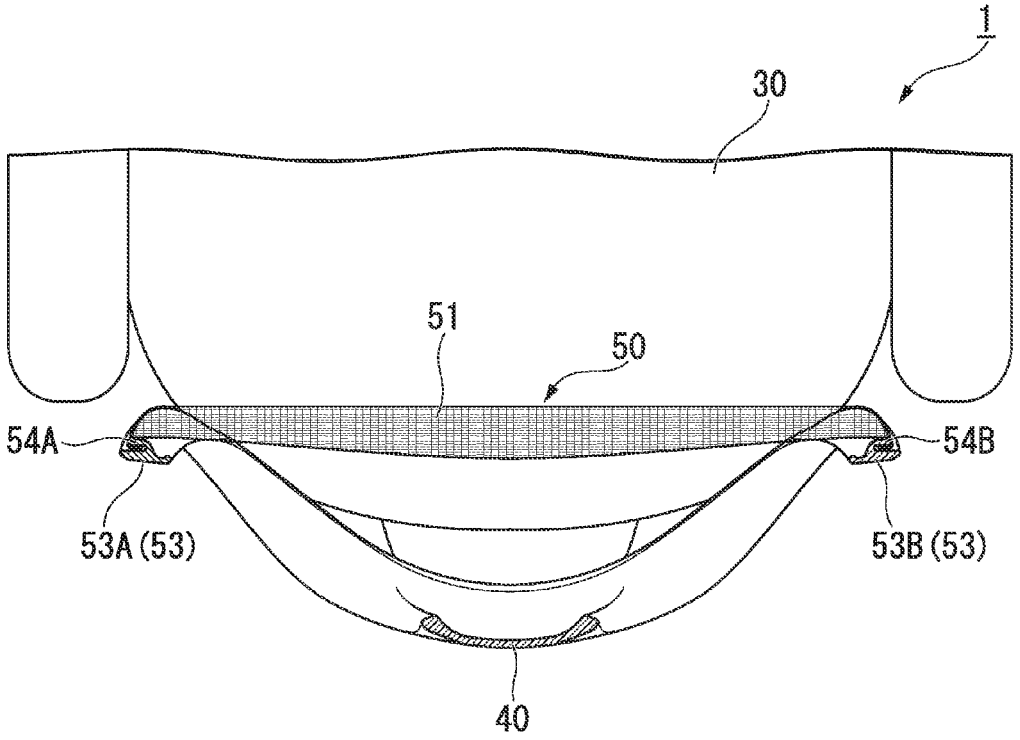
FIG. 6A is a cross-sectional view of the chair according to the first embodiment of the present invention when taken along line P-P of FIG. 4 at normal times.
Figure 6B:
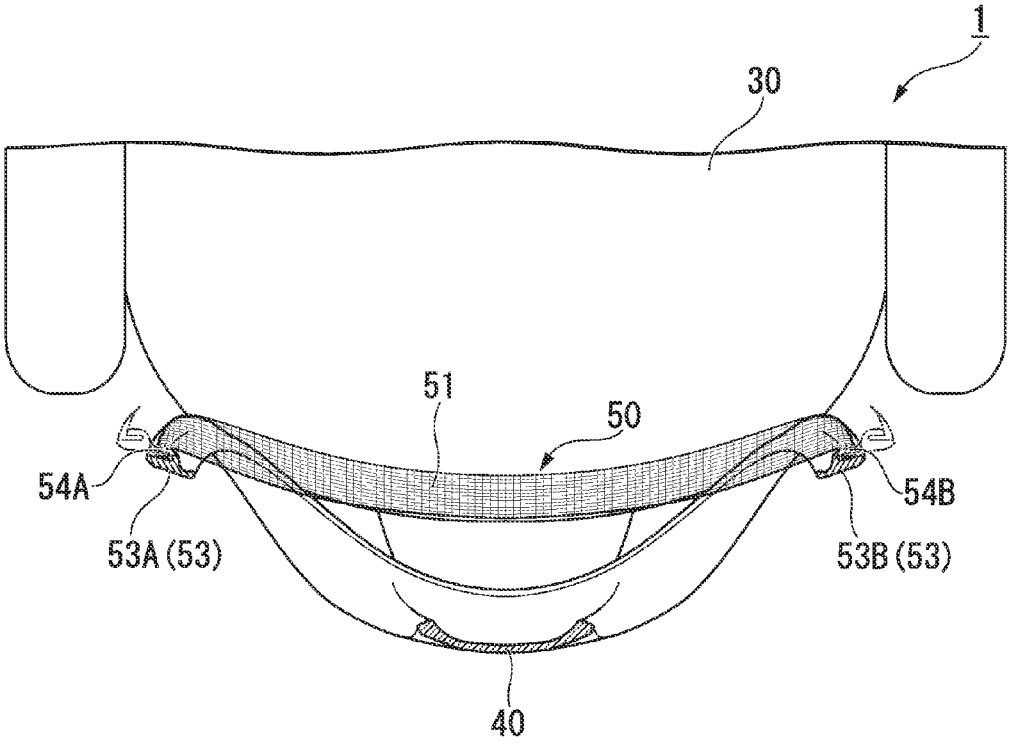
FIG. 6B is a cross-sectional view of the chair according to the first embodiment of the present invention when taken along line P-P of FIG. 4 in a state in which the user leans against the backrest.

A solid line of FIG. 4 and FIG. 6A show the chair 1 in a state in which the user sits on the seat section 30 and does not lean against the backrest 50, and a chain double dashed line of FIG. 4 and FIG. 6B show the chair 1 in a state in which the user leans against the backrest 50.

When the user leans against the backrest 50, a force from the user is applied to the upholstering material 51 of the backrest 50. As the threads constituting the mesh of the upholstering material 51 are elastically expanded and contracted by this force, approximately the middle of the upholstering material 51 in the width direction is elastically deformed in a circular arc shape so as to protrude backward along the back of the user as a whole.

Due to a force applied from the upholstering material 51, the vertical frame sections 53A and 53B to which the upholstering material 51 is fixed are elastically deformed to direct inner sides thereof in the width direction to the rear side and move to the inner sides thereof in the width direction so as to come close to each other.

As the vertical frame sections 53A and 53B are elastically deformed, the upholstering material 51 can be further deformed in a circular arc shape in which approximately the middle thereof protrudes backward, and the backrest 50 is supported by the backrest rear supporting member 40.

Figure 24A:
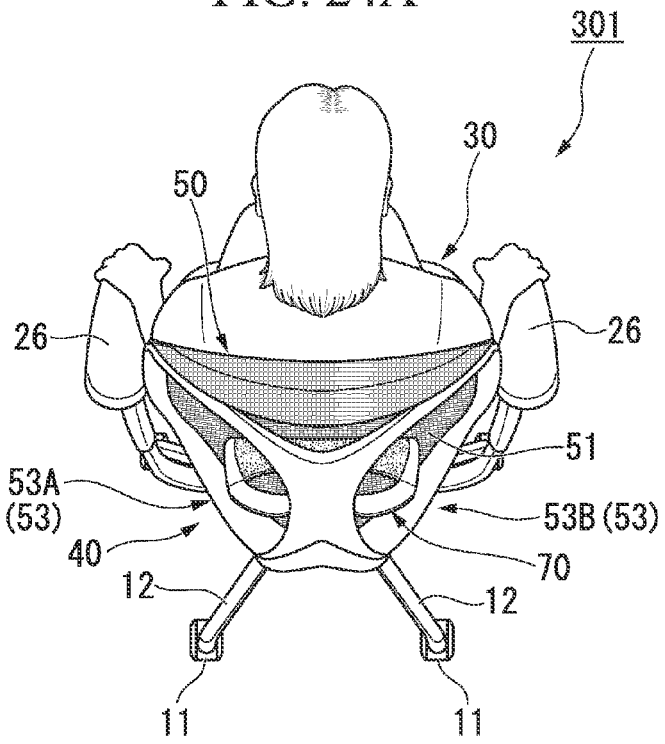
FIG. 24A is a perspective view of the chair according to the third embodiment of the present invention at normal times when viewed from the top.
Figure 24B:
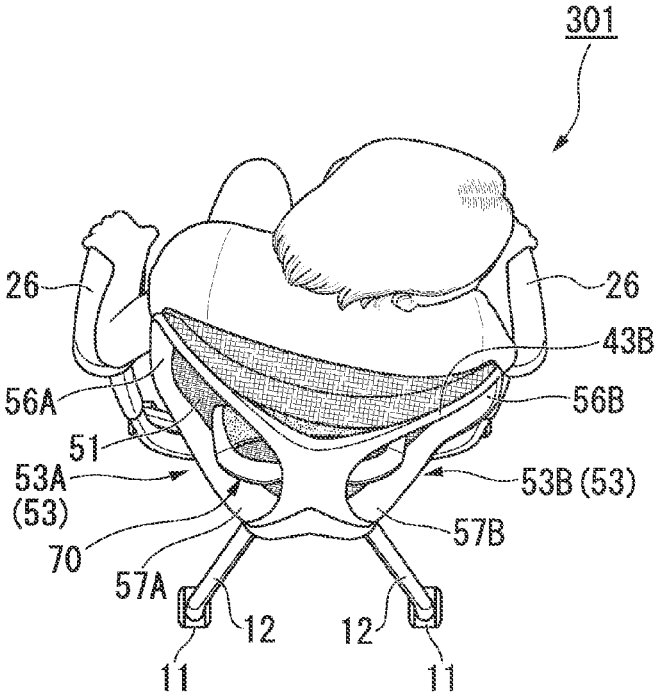
FIG. 24B is a perspective view of the chair according to the third embodiment of the present invention at normal times when the case that the user takes a posture of looking back from one side in a width direction to a rear side is viewed from the top.

Further, when the user takes a posture of looking back from one side of the backrest 50 in the width direction to the rear side, a load from the user is biased and applied to the one side of the backrest 50 in the width direction as illustrated in FIG. 24B, and a load causing twisting deformation of the vertical frame section 53B is applied to the vertical frame section 53B of the biased side.

Figure 5:
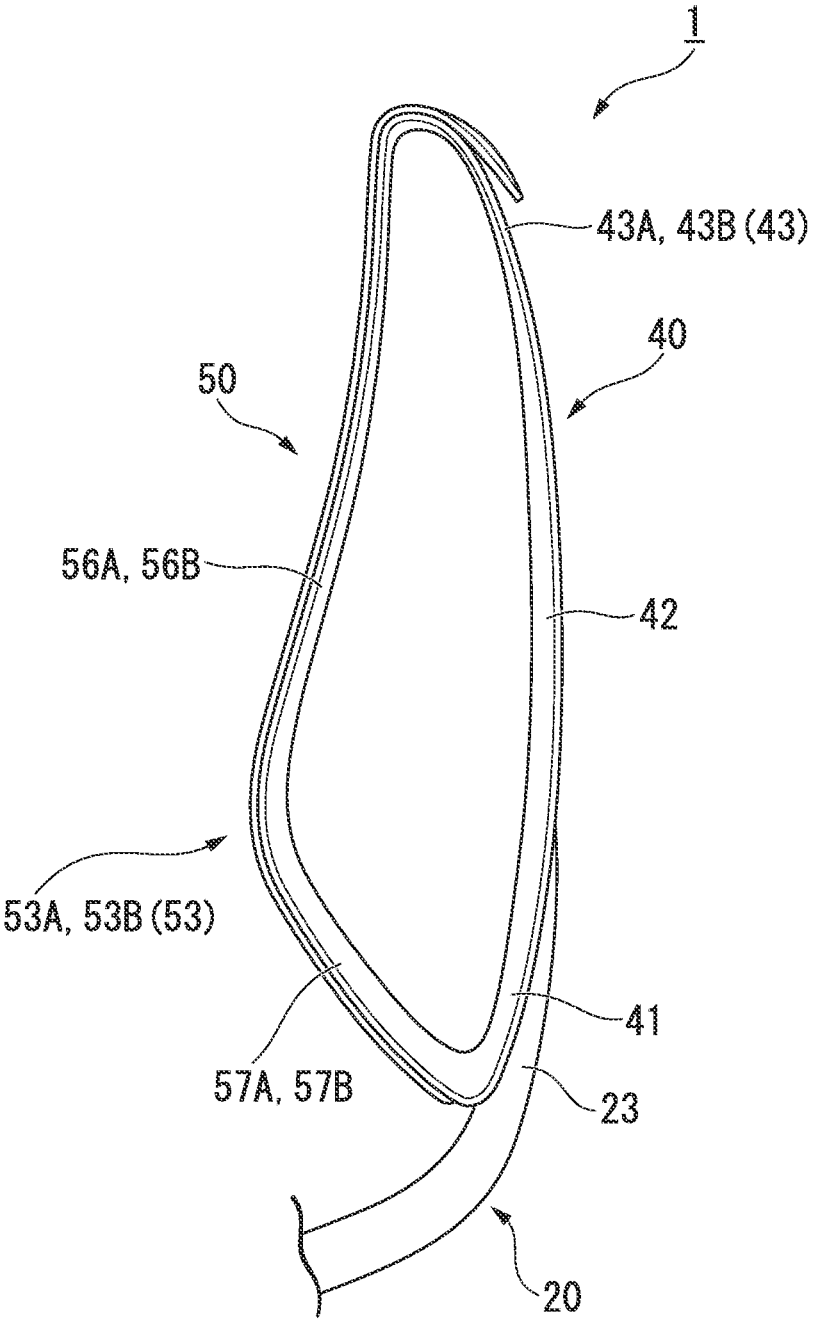
FIG. 5 is a side view of the chair according to the first embodiment of the present invention.

When the user greatly leans against the backrest 50, the deformable section 42 of the backrest rear supporting member 40 connected to the vertical frame sections 53A and 53B can be elastically deformed according to the load applied from the back of the user to the backrest 50 as indicated by a chain double dashed line of FIG. 5. Accordingly, the deformable section 42 is deformed to be gradually inclined backward toward the upper side, centering on the lower end thereof. Thus, along with the deformation of the deformable section 42, the upper connection section 43 disposed on an upper side of the deformable section 42 moves backward, and the backrest 50 connected to the upper connection section 43 can be further inclined backward.

Here, the upper material 56B in the vertical frame section 53B is configured to enable twisting deformation by the force applied from the backrest 50. The connection segments 43A and 43B are also formed to reduce the width to be separated toward the lower side, joined to each other, and connected to the deformable section 42. Thus, the deformable section 42 is configured to facilitate the twisting deformation of the upper material 56B. Accordingly, the upper material 56B is twisted and deformed toward a rear lateral side so as to conform the shape of the back of the user according to the load of the user.

In addition, the connection segments 43B connected to the upper material 56B is configured to be displaceable along with the twist of the upper material 56B, and thus is displaced to a rear lateral side along with twisting to a rear lateral side of the vertical frame section 53B.

The upholstering material 51 in the backrest 50 is elastically deformed such that the threads constituting the mesh of the upholstering material 51 are elastically expanded and contracted to wrap around the back of the user by the load from the user.

In this way, the upper material 56B, the connection segment 43B, and the upholstering material 51 are deformed to conform deformation of the back and shoulders of the user to wrap around the back and shoulders.

Even when the user takes a posture of looking back from the other side of the backrest 50 in the width direction to the rear side, the same movement is performed.

In the chair 1 configured in this way, when the user sits on the seat section 30 and the back of the user is received by the upholstering material 51 of the backrest 50, the load of the user is transmitted from the upholstering material 51 to the pair of vertical frame sections 53A and 53B. Since the upper materials 56A and 56B of the vertical frame sections 53A and 53B are connected to and supported by the upper connection section 43 of the backrest rear supporting member 40 that is connected to and supported by the backrest supporting body 20, and since the lower materials 57A and 57B are connected to the lower connection section 41 of the backrest rear supporting member 40, the load from the user can be reliably supported by the vertical frame sections 53A and 53B, the backrest rear supporting member 40, and the backrest supporting body 20.

When the user takes the posture of looking back from the one side in the width direction to the rear side is taken, the load from the user is biased and applied to the one side of the backrest 50 in the width direction, and the load causing twisting deformation of the vertical frame section 53A or 53B is applied to the vertical frame section 53A or 53B of the biased side. Since the upper material 56A or 56B of the vertical frame section 53A or 53B is subjected to the twisting deformation by the force applied from the upholstering material 51, it is deformed to conform the deformation of the back and shoulders of the user according to the load of the user and receives the back so as to wrap around the back along with the upholstering material, and the backrest 50 can be inclined backward.

When the load from the user is transmitted from the upholstering material 51 of the backrest 50 to the pair of vertical frame sections 53A and 53B, the upper materials 56A and 56B of the vertical frame sections 53A and 53B are twisted and deformed. The pair of connection segments 43A and 43B connected to the upper materials 56A and 56B are displaced along with the twisting deformation of the upper materials 56A and 56B. Accordingly, when the user the posture of looking back from the one side in the width direction to the rear side, the upper material 56A or 56B of the one side is twisted and deformed, and the connection segment 43A or 43B of the one side is displaced. The component of the one side can receive the back so as to wrap around the back along with the upholstering material, and thus stably support the back and shoulders of the user in a state in which it conforms the deformation.

In this way, the upper material 56A or 56B of the vertical frame section 53A or 53B, the upholstering material 51, and the connection segment 43A or 43B can conform the change of the positions of the user's back and shoulders of the user and stably support them while being inclined backward.

On the other hand, the lower materials 57A and 57B of the vertical frame sections 53A and 53B reliably support, for instance, the circumference of the waist at a lower side relative to the back of the user along with the upholstering material 51. Accordingly, when the user takes the posture of looking back from the one side in the width direction to the rear side, the lower materials 57A and 57B can support the circumference of the waist of the user along with the upholstering material 51.

With respect to the force applied backward from the user, when the back of the user is received by the upholstering material 51 of the backrest 50, the load of the user is transmitted from the upholstering material 51 to the upper frame section 52 and the pair of vertical frame sections 53A and 53B. The upper frame section 52 is connected to and supported by the pair of connection segments 43A and 43B of the backrest rear supporting member 40, and the backrest rear supporting member 40 is supported by the backrest supporting body 20. Accordingly, the load from the user can be reliably supported by the upper frame section 52, the backrest rear supporting member 40, and the backrest supporting body 20.

On the other hand, since the pair of vertical frame sections 53A and 53B connected to both ends of the upper frame section 52 in the width direction are elastically deformed by the force applied from the upholstering material 51, they can be deformed to conform the back of the user according to the load of the user and receive the back so as to wrap around the back along with the upholstering material 51. For this reason, the user can sits down on the seat in a stable state.

Since the upper materials 56A and 56B constituting the vertical frame sections 53A and 53B are elastically deformed by the force applied from the upholstering material 51, they can be deformed to conform the back of the user according to the load of the user and receive the back so as to wrap around the back along with the upholstering material 51.

On the other hand, since the lower materials 57A and 57B constituting the vertical frame sections 53A and 53B are formed to be gradually inclined forward toward the upper side, the load applied backward from the user can be received by tips of the lower materials 57A and 57B and be reliably supported by axial forces of the lower materials 57A and 57B.

In this way, the vertical frame sections 53A and 53B are formed by the lower materials 57A and 57B so as to gradually turn to the rear side toward the upper side from the lower portions thereof and are formed by the upper materials 56A and 56B so as to gradually turn to the front side toward the upper side from the connected portions of the lower materials 57A and 57B and the upper materials 56A and 56B, thereby being curved to become convex forward as a whole. Accordingly, it is possible to suppress the deformation of the vertical frame sections 53A and 53B to reliably receive the load of the user in the forward/backward direction, and the vertical frame sections 53A and 53B can be directed inward, be bent and deformed to conform the back of the user, and receive the back so as to wrap around the back in the width direction.

In the chair 1 configured in this way, when the load is applied backward from the user to the backrest 50, the load of the user is transmitted to the upper connection section 43 of the backrest rear supporting member 40 supporting the upper frame section 52 of the backrest 50. In this case, the deformable section 42 of the backrest rear supporting member 40 interposed between the lower connection section 41 connected to the backrest supporting body 20 and the upper connection section 43 connected to the backrest 50 is elastically deformed to be gradually inclined backward toward the upper side. Along with the deformation of the deformable section 42, the backrest 50 supported by the backrest rear supporting member 40 allows a position thereof to be greatly inclined backward.

The upper connection section 43 is also provided at the upper side relative to the deformable section 42 inclined backward. Accordingly, as the deformable section 42 is inclined backward, the upper connection section 43 can move backward while keeping the upper end thereof connected to the backrest 50. Thus, when the load of the user is applied in a direction in which it reclines the backrest backward, the backrest 50 can be inclined backward by conforming a motion of reclining the backrest 50.

In a normal state, the upper connection section 43 is formed to be gradually inclined forward toward the upper side. Thus, it is possible to suppress the deformation of the upper connection section 43 to support the load of the user in the forward/backward direction, and the backrest 50 connected to the upper connection section 43 can also reliably support the load of the user.

On the other hand, when the user causes a load greater than in the normal state to be applied to the backrest backward in order to recline their back backward, the deformable section 42 is deformed by the load. Thereby, the backrest 50 connected to the lower and upper connection sections 41 and 43 of the backrest rear supporting member 40 can be inclined backward depending on the load of the user, and be conformed to the motion of inclining the back of the user backward.

Meanwhile, the pair of connection segments 43A and 43B of the upper connection section 43 are connected to the backrest 50 at the upper ends thereof, and thereby can reliably support the load applied to the one side or the other side of the backrest 50 in the width direction.

Since the lower materials 57A and 57B are inclined forward toward the upper side, it is possible to suppress the deformation of the lower materials 57A and 57B and to reliably support the load of the user.

On the other hand, since the upper materials 56A and 56B are formed to be gradually inclined backward toward the upper side from the upper ends of the lower materials 57A and 57B, they can be inclined backward according to the load of the user and be conformed to the motion of inclining the back of the user backward.

Here, in the backrest 50 connected to the lower and upper connection sections 41 and 43 of the backrest rear supporting member 40 at the lower and upper portions thereof, the deformation of the lower materials 57A and 57B is suppressed, and the backrest 50 is inclined within a range of the upper materials 56A and 56B in the upward/downward direction. Accordingly, when the backrest rear supporting member 40 is inclined backward, the upper materials 56A and 56B are inclined at an oblique angle greater than that of the backrest rear supporting member 40.

For this reason, the backrest 50 can be greatly inclined backward and be more effectively conformed with respect to the back of the user while an amount of the deformation of the deformable section 42 of the backrest rear supporting member 40 is suppressed to the minimum extent. Accordingly, even when the deformation of the deformable section 42 is repeated and moment is concentrated, there is no fear of damage or breakage.

With respect to the force applied backward from the user, when the back of the user is received by the upholstering material 51 of the backrest 50, the load of the user is transmitted from the upholstering material 51 to the upper frame section 52 and the pair of vertical frame sections 53A and 53B. The upper frame section 52 is connected to and supported by the pair of connection segments 43A and 43B of the backrest rear supporting member 40, and the backrest rear supporting member 40 is supported by the backrest supporting body 20. Accordingly, the load from the user can be reliably supported by the upper frame section 52, the backrest rear supporting member 40, and the backrest supporting body 20.

On the other hand, since the upper materials 56A and 56B of the pair of vertical frame sections 53A and 53B which are connected to both ends of the upper frame section 52 in the width direction are elastically bent and deformed by the force applied from the upholstering material 51, they can be deformed to conform the back of the user according to the load of the user and be received to wrap around the back along with the upholstering material 51. For this reason, the user can sits down on the seat in a stable state.

Second Embodiment

Figure 7:
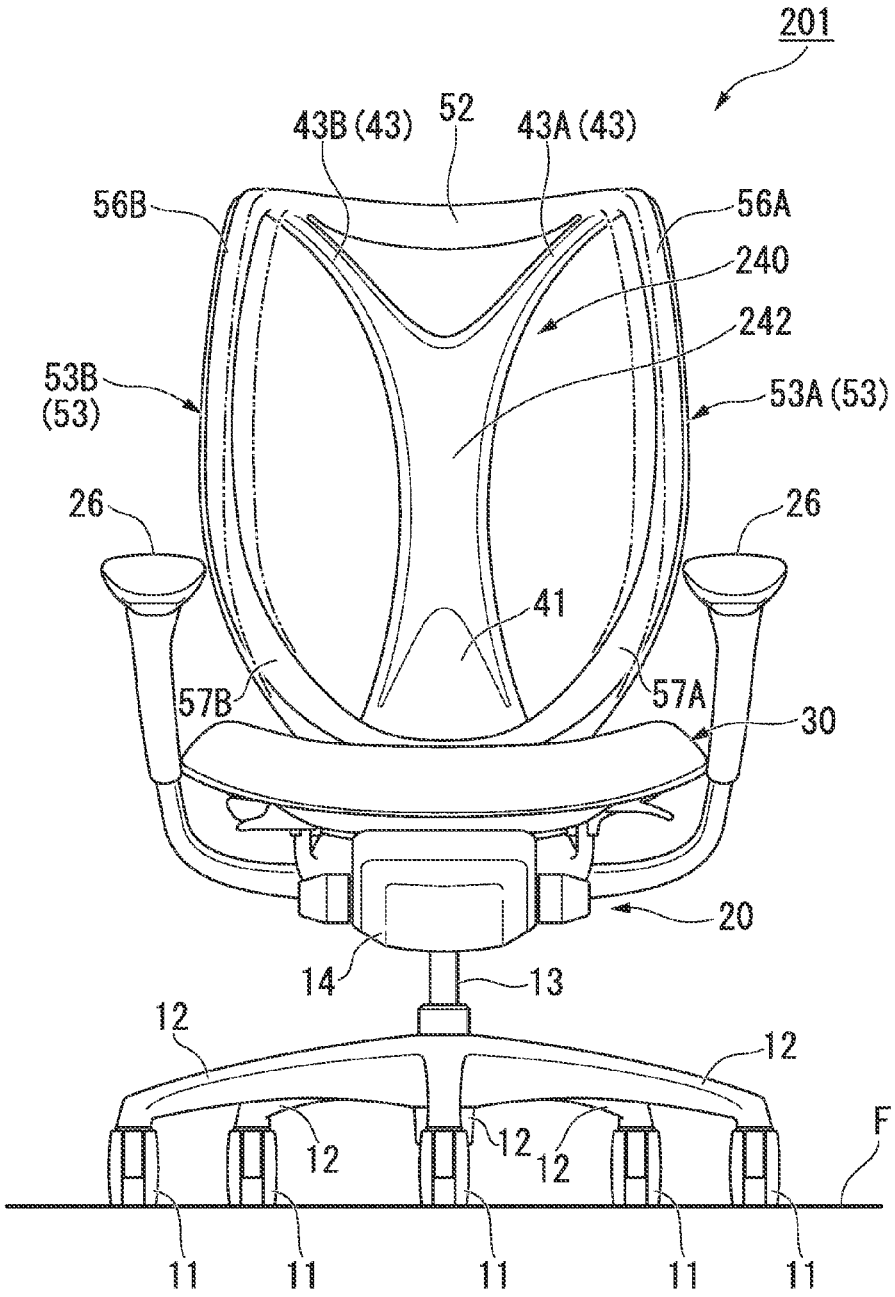
FIG. 7 is an exploded perspective view of a chair according to a second embodiment of the present invention when viewed from the front.

Hereinafter, a chair 201 according to a second embodiment of the present invention will be described using FIGS. 7 and 8.

In this embodiment, members identical to those used in the aforementioned embodiment are given the same signs, and description thereof will be omitted.

In the chair 1 according to the first embodiment, the deformable section 42 disposed between the lower connection section 41 and the upper connection section 43 of the backrest rear supporting member 40 is configured to support the load applied from the back of the user to the backrest 50. On the other hand, in the chair 201 according to the present embodiment, a member disposed between a lower connection section 41 and an upper connection section 43 of a backrest rear supporting member 240 is configured as a deformable section 242.

The deformable section 242 is connected to the lower connection section 41 at a lower end thereof and to the upper connection section 43 at an upper end thereof, and no ribs are formed on a front surface of the deformable section 242. In addition, the deformable section 242 can be elastically deformed according to a load applied from the back of a user to a backrest 50.

Next, when a user sits on a seat section 30 of the chair 201 configured as described above and leans against the backrest 50 (see FIG. 1 and below is the same), movements of the backrest rear supporting member 240 and the backrest 50 of the chair 201 will be described.

A solid line of FIG. 8 shows the chair 201 in a state in which the user sits on the seat section 30 and does not lean against the backrest 50, and a chain double dashed line of FIG. 8 shows the chair 201 in a state in which the user leans against the backrest 50.

When the user leans against the backrest 50, a force from the user is applied to an upholstering material 51 of the backrest 50, the upholstering material 51 is deformed in a circular arc shape by this force such that approximately the middle thereof in the width direction protrudes backward along the back of the user.

Due to a force applied from the upholstering material 51, vertical frame sections 53A and 53B to which the upholstering material 51 is fixed are elastically deformed to direct inner sides thereof in the width direction to a rear side and move to the inner sides thereof in the width direction so as to come close to each other.

In addition, the deformable section 242 of the backrest rear supporting member 240 connected to the vertical frame sections 53A and 53B can be elastically deformed according to the load applied from the back of the user to the backrest 50.

Accordingly, the deformable section 242 is deformed to be gradually inclined backward toward the upper side centering on the lower end thereof. Along with the deformation of the deformable section 242, the upper connection section 43 disposed on an upper side of the deformable section 242 moves backward, and the backrest 50 connected to the upper connection section 43 can be further inclined backward.

In the chair 201 configured in this way, when the load is applied backward from the user to the backrest 50, the load of the user is transmitted to the backrest rear supporting member 240 supporting the backrest 50. In this case, the deformable section 242 of the backrest rear supporting member 240 interposed between the lower connection section 41 connected to the backrest supporting body 20 and the upper connection section 43 connected to the backrest 50 is elastically deformed to be gradually inclined backward toward the upper side. Along with the deformation of the deformable section 242, the backrest 50 supported by the backrest rear supporting member 240 allows a position thereof to be greatly inclined backward.

Third Embodiment

Hereinafter, a chair 301 according to a third embodiment of the present invention will be described using FIG. 9.

In this embodiment, members identical to those used in the aforementioned embodiment are given the same signs, and description thereof will be omitted.

The chair 301 in the third embodiment is further equipped with a lumbar support 70 that is connected to a front side of a backrest rear supporting member 40 and supports the lumbar area of a user.

Figure 10A:
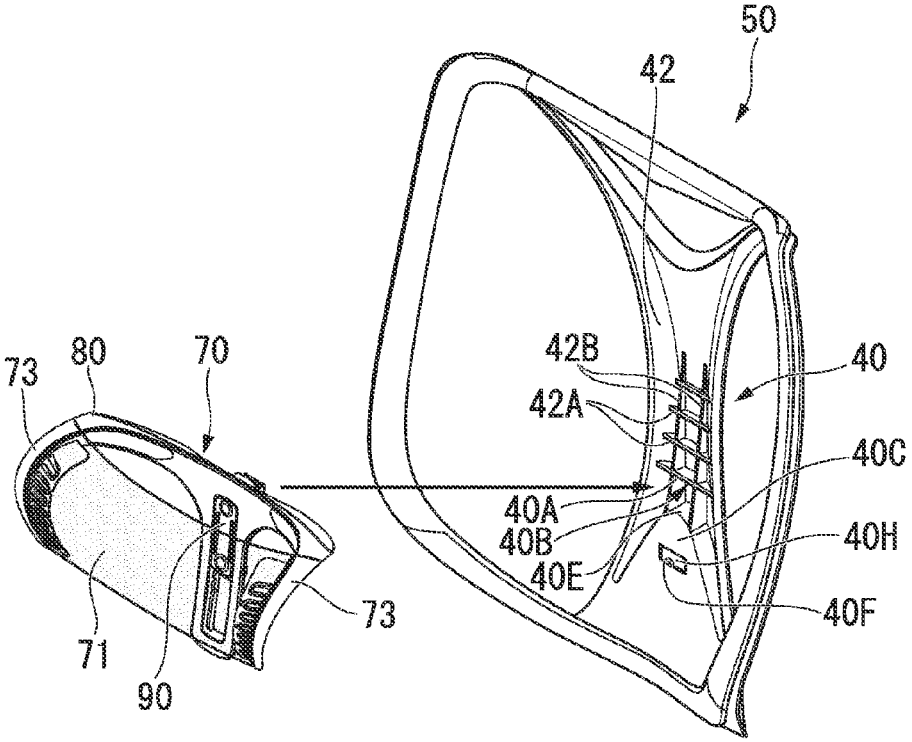
FIG. 10A is a perspective view for describing a schematic constitution of the chair according to the third embodiment of the present invention and is a view illustrating a state prior to connecting a lumbar support to a backrest.
Figure 10B:
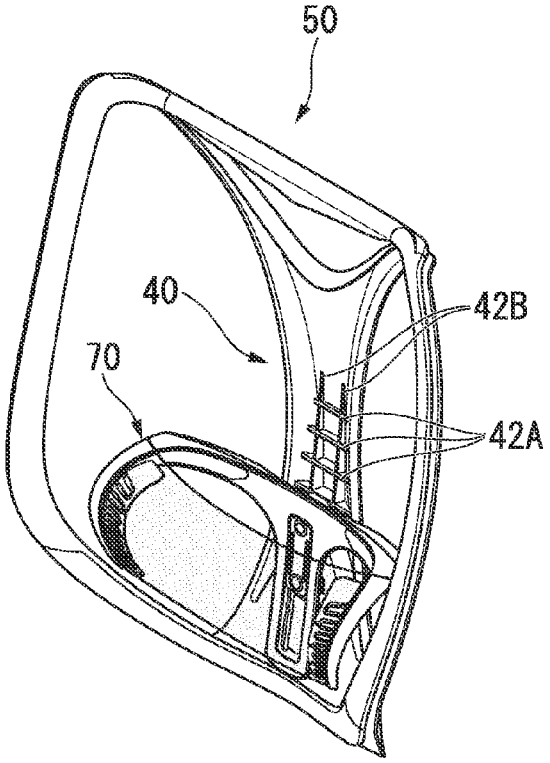
FIG. 10B is a perspective view for describing the schematic constitution of the chair according to the third embodiment of the present invention and is a view illustrating a state in which the lumbar support is connected to the backrest.

As illustrated in FIGS. 10A and 10B, the deformable section 42 is formed with three transverse ribs 42A and an engaging rib 40A that is engaged with the lumbar support 70 disposed below the transverse ribs 42A and is formed with two longitudinal ribs 42B so as to intersect the transverse ribs 42A and the engaging rib 40A.

Lumbar Support

Figure 11A:
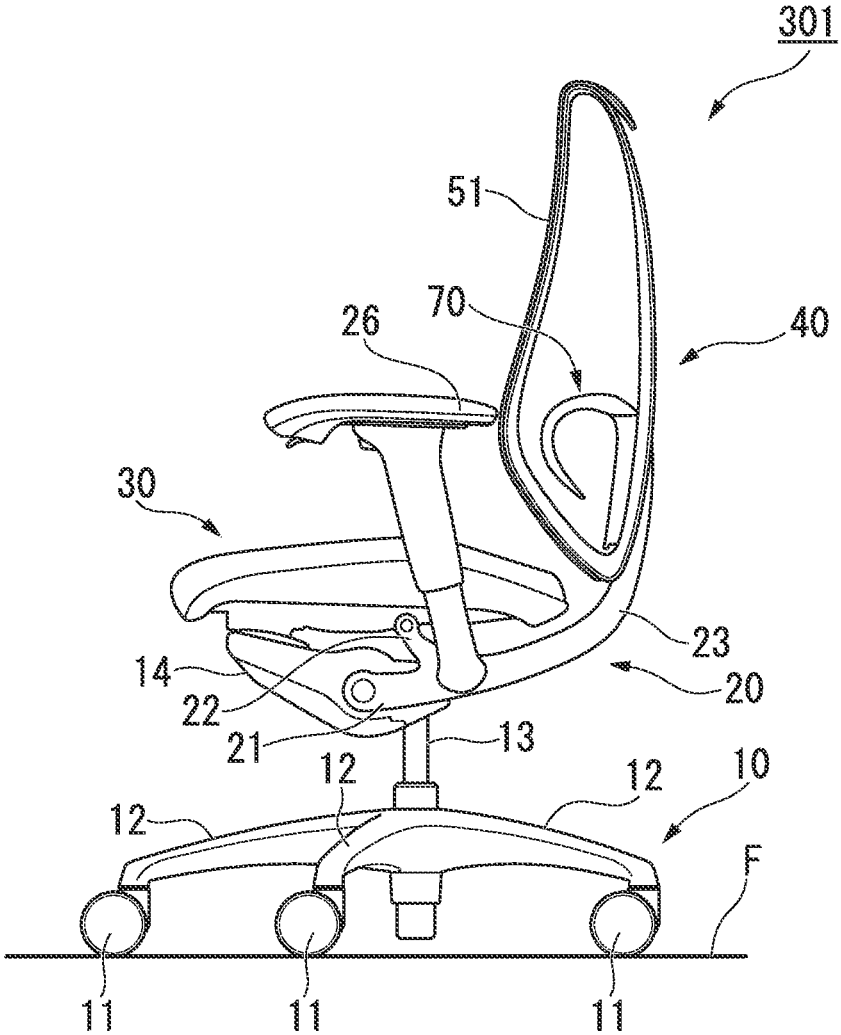
FIG. 11A is a side view of the chair according to the third embodiment of the present invention and is a side view illustrating normal times.
Figure 12:
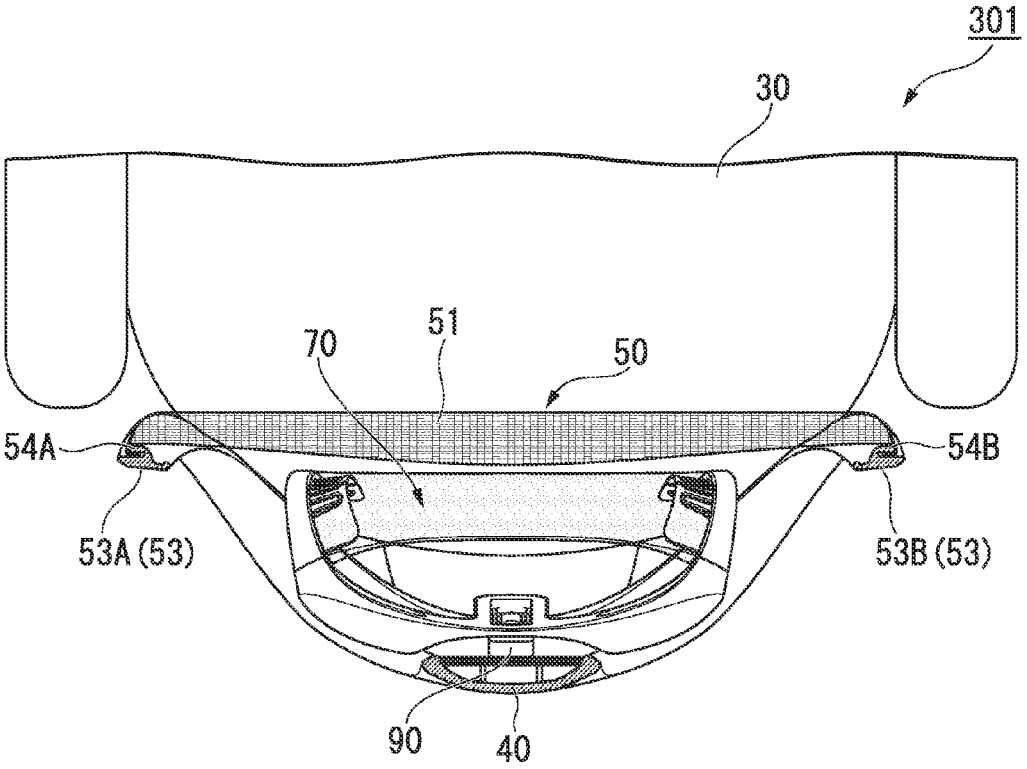
FIG. 12 is a view illustrating a cross section of an upper portion of a lumbar support in a state in which the user does not sits down on the seat with regard to the chair according to the third embodiment of the present invention.
Figure 13A:
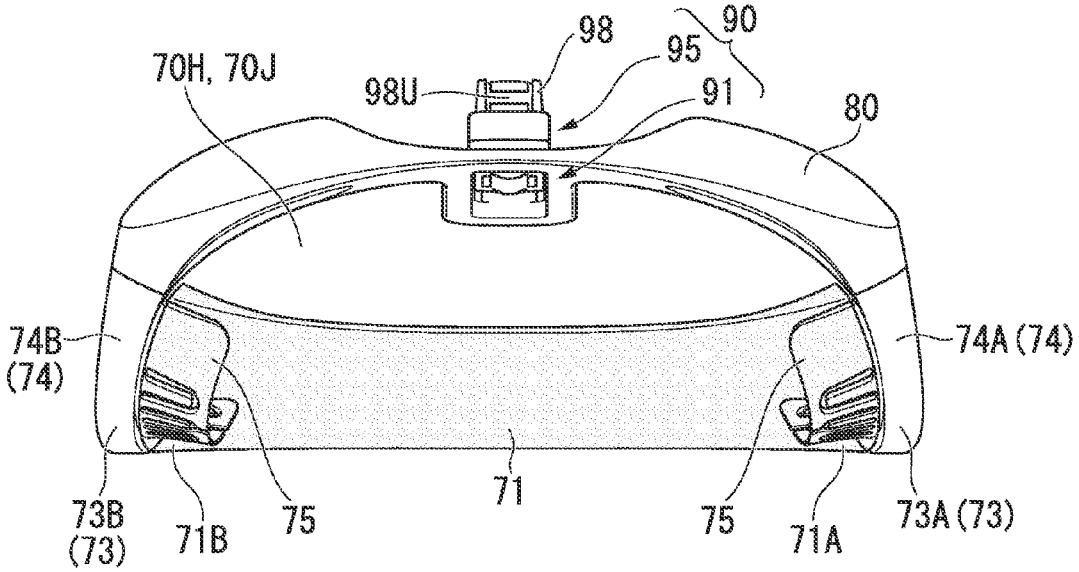
FIG. 13A is a top view illustrating the lumbar support according to the third embodiment of the present invention.
Figure 13B:
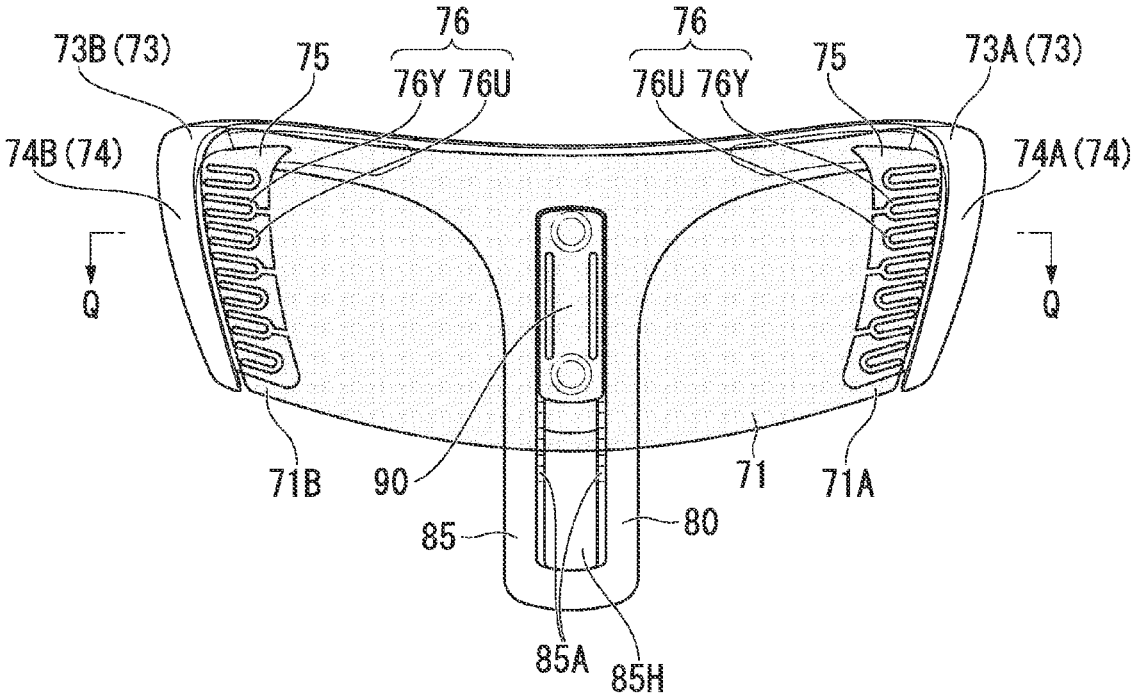
FIG. 13B is a view illustrating the lumbar support according to the third embodiment of the present invention when viewed from the front.
Figure 14A:
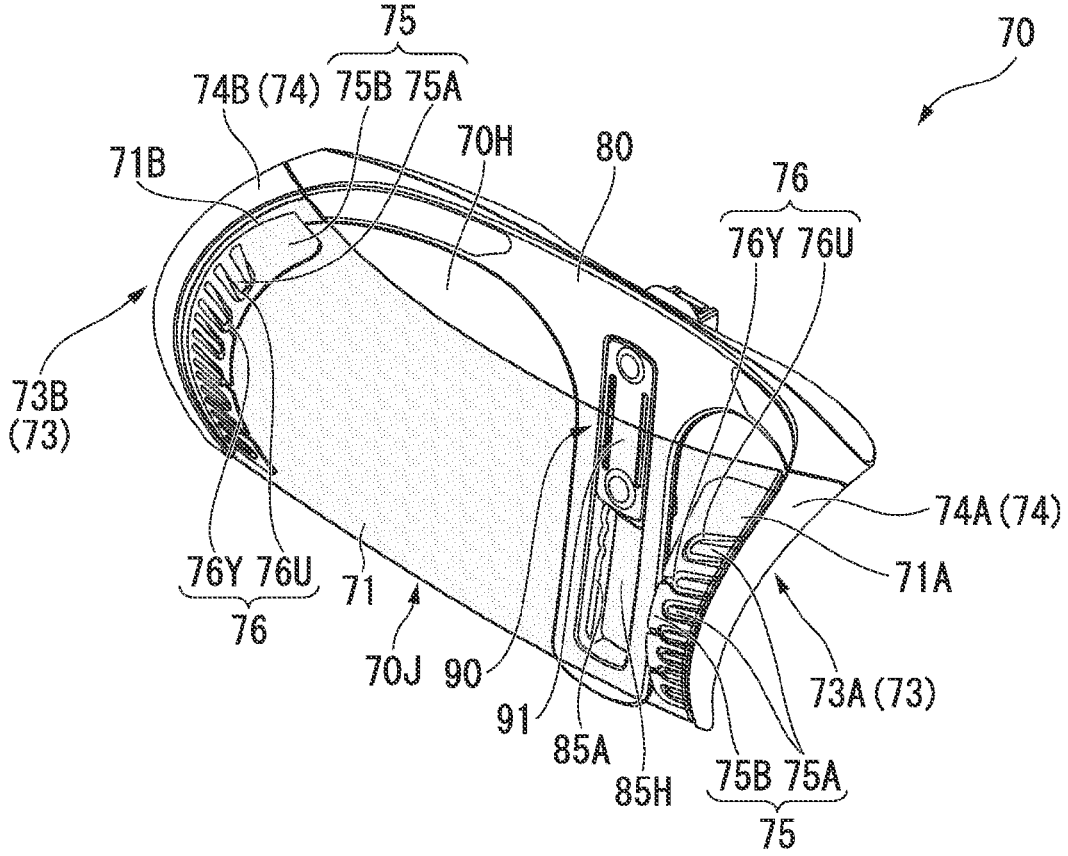
FIG. 14A is a perspective view illustrating a schematic constitution of the lumbar support according to the third embodiment of the present invention when viewed from the oblique front side.
Figure 14B:
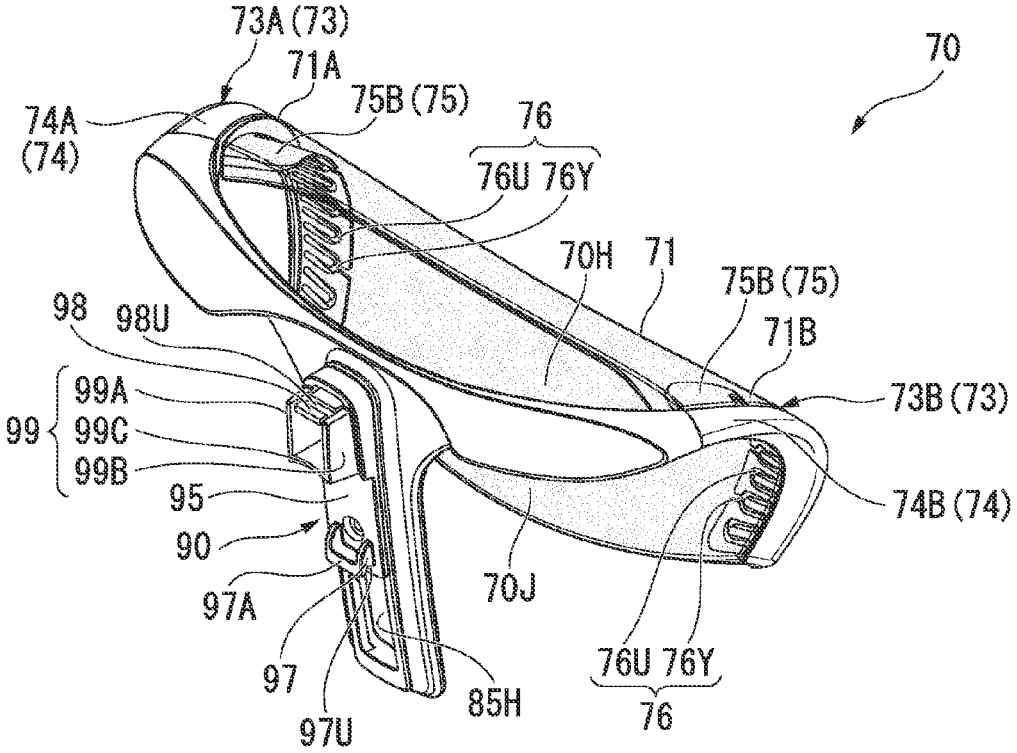
FIG. 14B is a perspective view illustrating a schematic constitution of the lumbar support according to the third embodiment of the present invention when viewed from the oblique rear side.

As illustrated in FIGS. 11A and 12, the lumbar support 70 is connected to a front side of the backrest rear supporting member 40 at a rear side of the upholstering material 51 constituting the backrest 50 and bulges out toward a front side of the backrest 50 when viewed from the side. In the present embodiment, the lumbar support 70 is configured to form a gap from the upholstering material 51 is formed such that the lumbar support 70 and the upholstering material 51 do not come into contact with each other.

Figure 9:
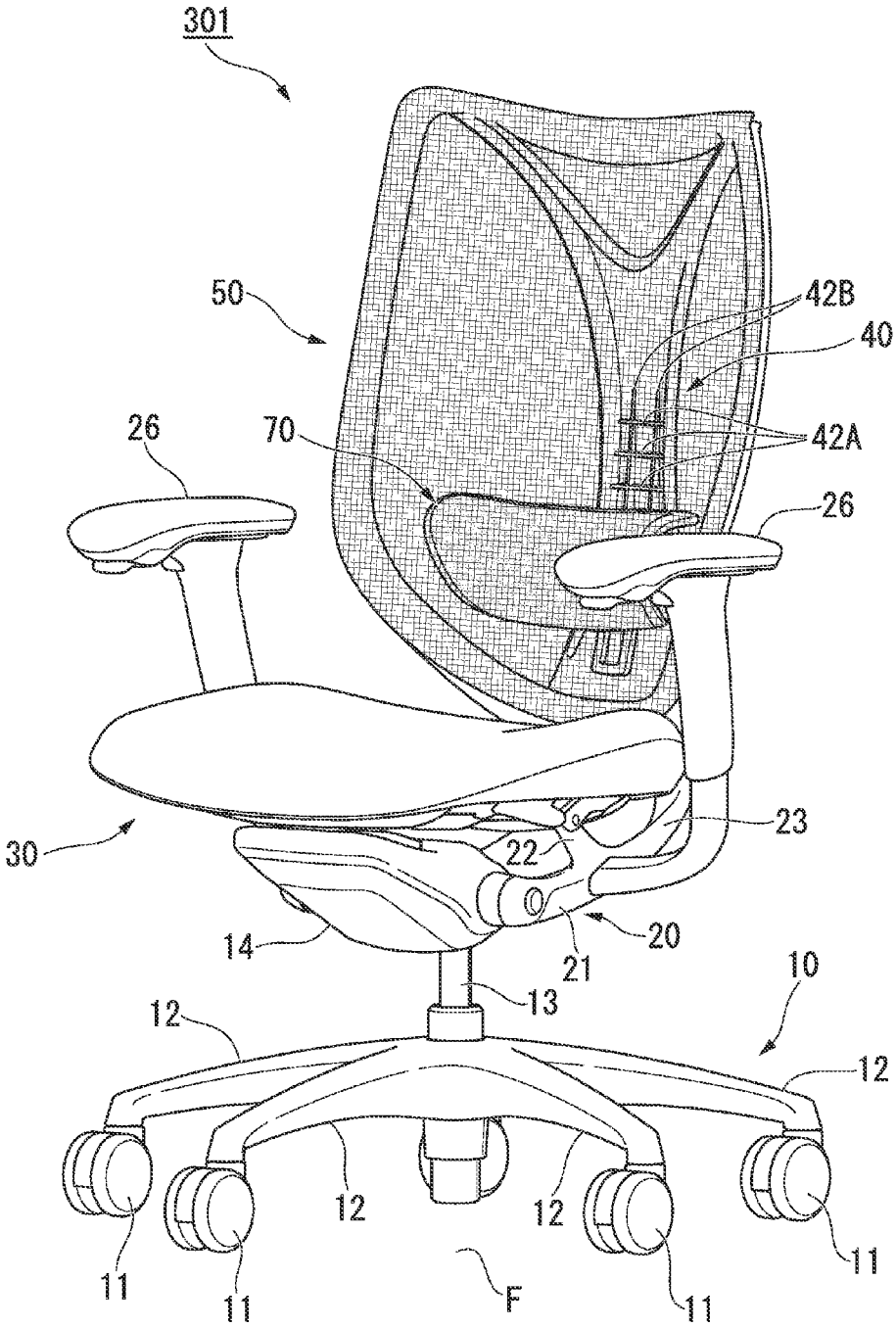
FIG. 9 is a perspective view of a chair according to a third embodiment of the present invention when viewed from the oblique front side.
Figure 11B:
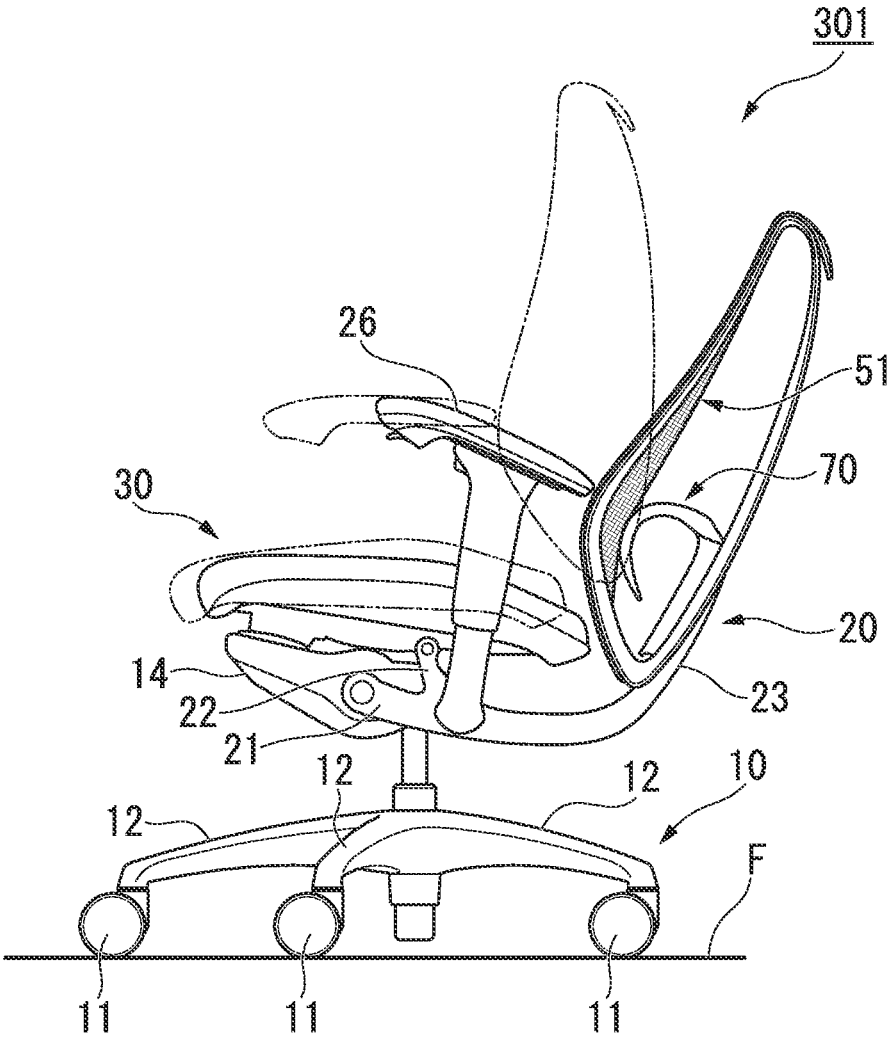
FIG. 11B is a side view for describing the schematic constitution of the chair according to the third embodiment of the present invention and is a side view illustrating a state in which a user is tilted on a backrest backward.

As illustrated in FIGS. 9, 11A and 11B, the lumbar support 70 is equipped with, for example, a lumbar support main body 71, a pair of left and right lateral frame members 73A and 73B (73), a mounting member 80, and a connecting member 90. The lumbar support main body 71 is connected to the lateral frame members 73A and 73B (73) at supporting portions located at both left and right edges 71A and 71B.

The lumbar support 70 is also configured to hold the lateral frame members 73A and 73B (73) by means of the mounting member 80 and to be connected to the backrest rear supporting member 40 via the connecting member 90 mounted to the mounting member 80.

In the lumbar support 70, rear sides of upper and lower edges of the lumbar support main body 71 are configured to form gaps from the backrest 50. To be specific, the upper and lower edges of the lumbar support main body 71 form gaps 70H and 70J from the mounting member 80 and become free edges, and the entire region of the lumbar support main body 71 in an upward/downward direction is easily deformed backward between the left edge 71A and the right edge 71B.

As illustrated in FIGS. 14A to 16, the lumbar support main body 71 is formed of, for example, an elastically deformable soft material such as a urethane resin or an elastomer having translucency such as semitransparency and is formed of a sheet-like face material extending in a leftward/rightward direction of the backrest 50. In addition, protrusion parts 75 formed at the lateral frame members 73A and 73B (73) enter from end faces of both of the left and right edges 71A and 71B, are mounted on the lateral frame members 73, and follow support geometry parts of the lateral frame members 73. Thereby, the lumbar support main body 71 is formed to bulge out forward.

The lateral frame members 73 are provided with a pair of left and right lateral frame member main bodies 74A and 74B (74) in which the support geometry parts bulging out to the front side of the backrest 50 when viewed from the side are formed and on which the lumbar support main body 71 is mounted, the protrusion parts 75 that protrude from the pair of left and right lateral frame member main bodies 74A and 74B (74) and extend toward the left and right edges 71A and 71B of the lumbar support main body 71, and plug-in parts 77A and 77B (77).

In this embodiment, the plurality of protrusion parts 75 are formed along the support geometry parts formed at the lateral frame member main bodies 74A and 74B (74) and lock the left and right edges 71A and 71B of the lumbar support main body 71. With such a constitution, the lumbar support main body 71 bulges forward.

Figure 15:
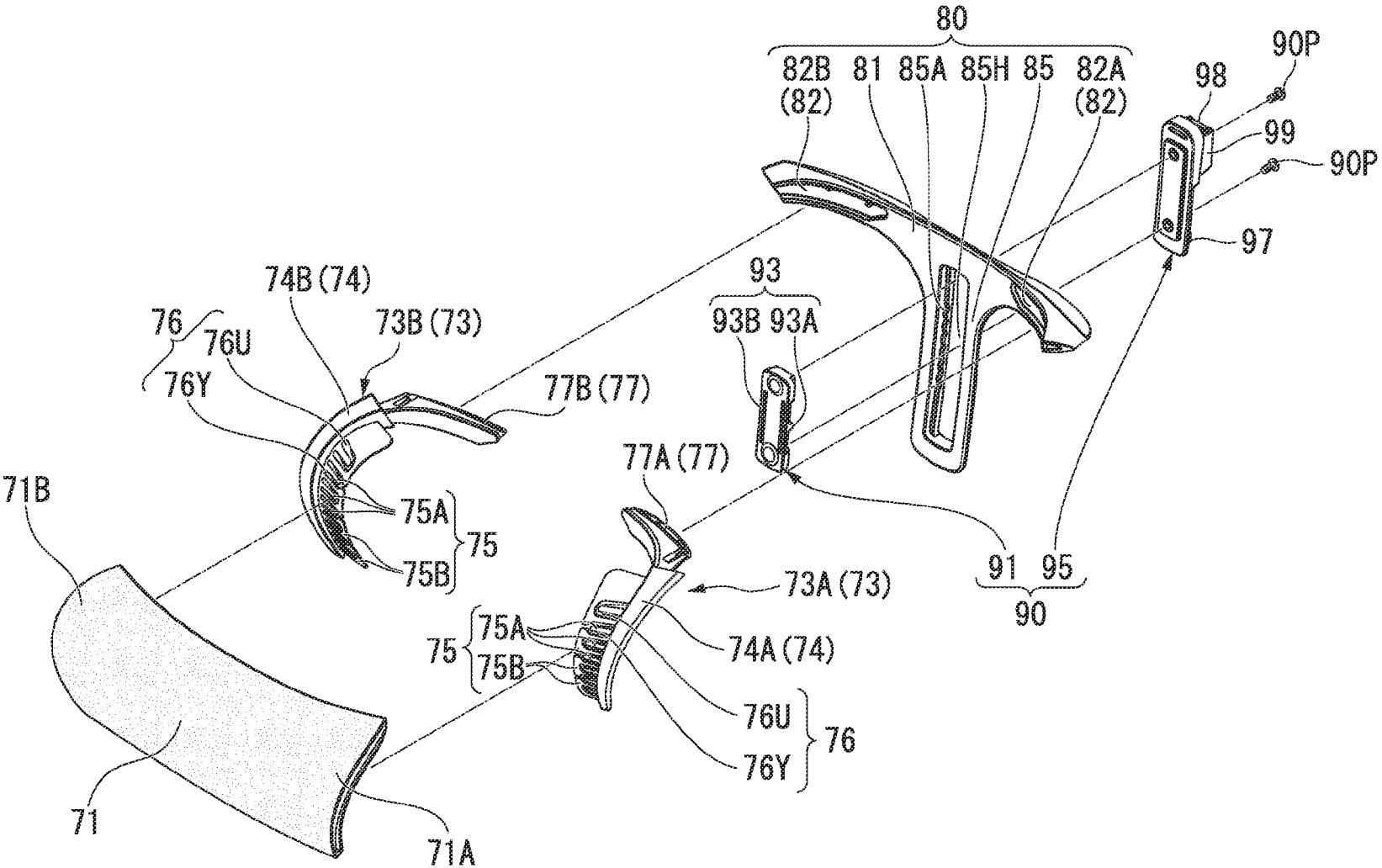
FIG. 15 is a view for describing a schematic constitution of the lumbar support according to the third embodiment of the present invention and is a perspective view when constituent members of the lumbar support are viewed from the oblique front side.
Figure 16:
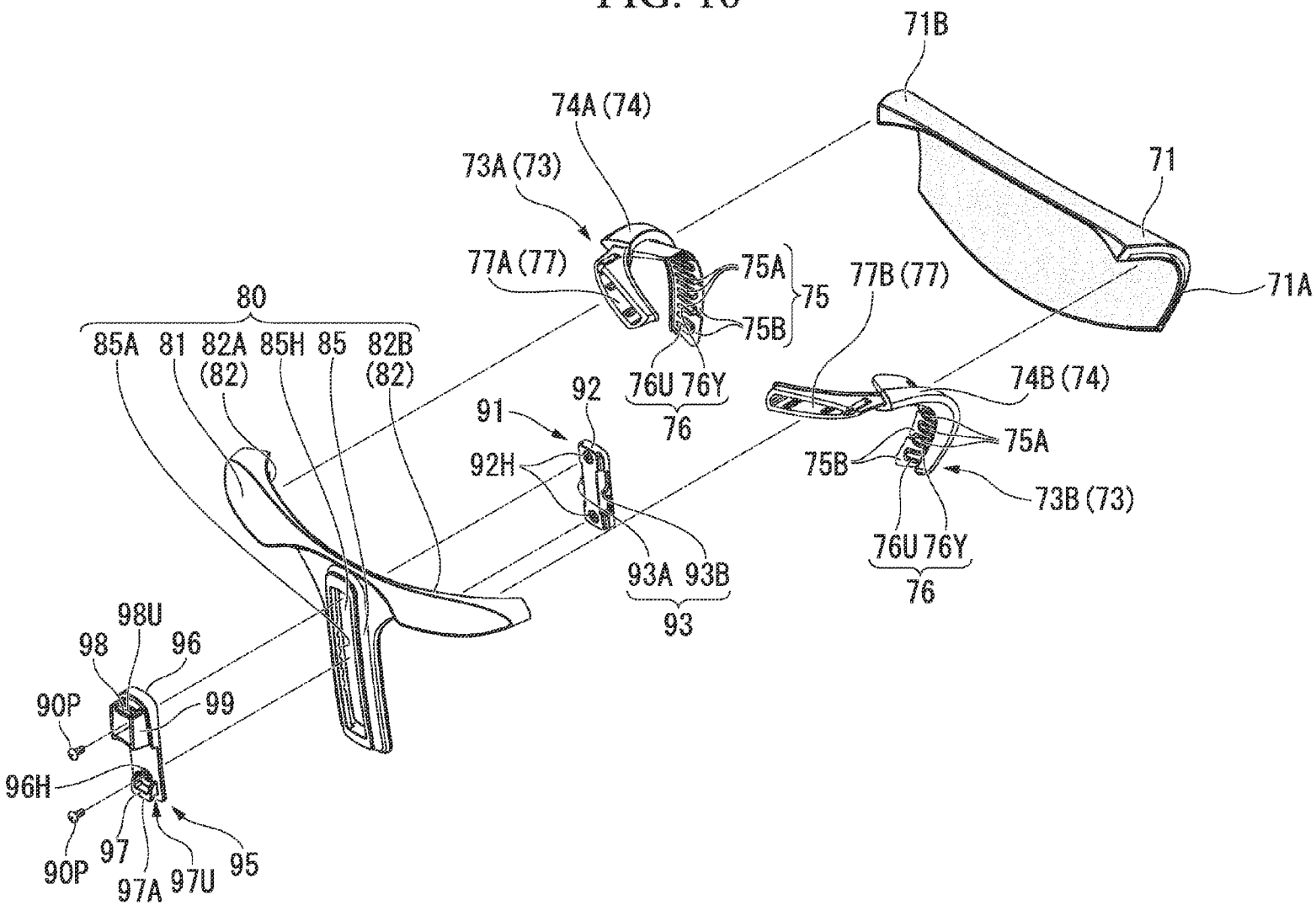
FIG. 16 is a view for describing a schematic constitution of the lumbar support according to the third embodiment of the present invention and is a perspective view when constituent members of the lumbar support are viewed from the oblique rear side.

The protrusion parts 75 are formed of an elastically deformable material. For example, as illustrated in FIGS. 15 and 16, each protrusion part 75 includes a plurality of tongue-like protrusion parts 75A that protrude from the lateral frame member main body 74A or 74B (74) and a plurality of perforated locking wall parts 75B that alternately enclose circumferences of the tongue-like protrusion parts 75A and include a perforated locking wall part in which a through-hole 76U is defined between the enclosed tongue-like protrusion parts 75A. The neighboring perforated locking wall parts 75B are separated by a slit 76Y formed between both the neighboring tongue-like protrusion parts 75A that are not enclosed by the perforated locking wall parts 75B.

The protrusion parts 75 are, for example, formed to enter into the lumbar support main body 71 from the edges 71A and 71B of the lumbar support main body 71 by insert molding when the lumbar support main body 71 is formed.

Figure 17A:
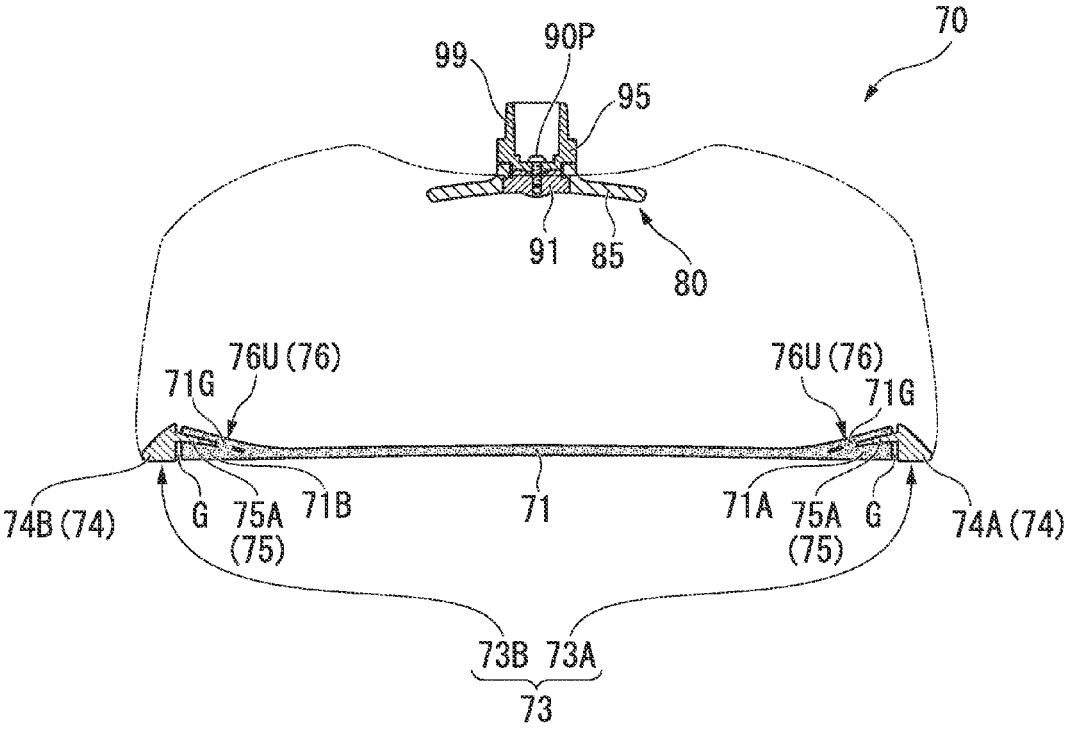
FIG. 17A is a view illustrating a cross section taken along line Q-Q of FIG. 13B in the chair according to the third embodiment of the present invention and is a view illustrating a mode in which gaps are formed between edges and lateral frame members of a lumbar support main body.
Figure 17B:
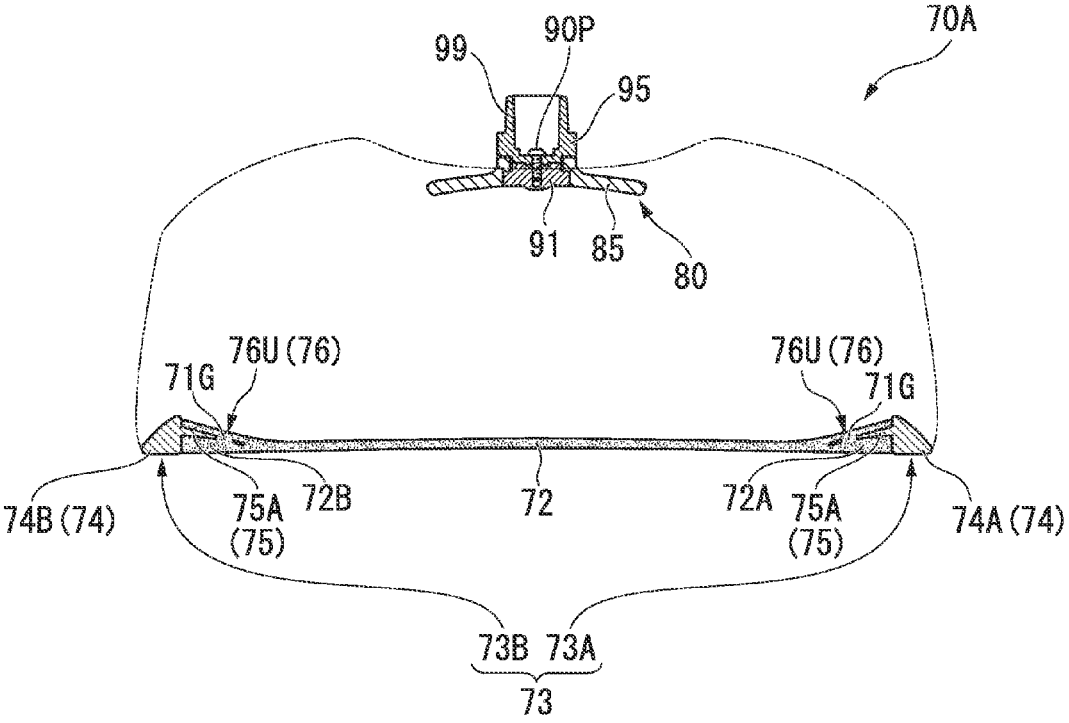
FIG. 17B is a view illustrating a cross section taken along line Q-Q of FIG. 13B in the chair according to the third embodiment of the present invention and is a view illustrating a mode according to a modification in which the edges and the lateral frame members of a lumbar support main body come into contact with each other.

Thus, during the insert molding, the lumbar support main body 71 is, as illustrated in FIGS. 17A and 17B, supported by wall parts (locked parts) 71G that are integrally formed through the through-holes 76U in a thickness direction of the protrusion parts 75 inside the lumbar support main body 71.

The plug-in parts 77A and 77B (77) are formed by bending and extending from rear ends of the lateral frame member main bodies 74A and 74B (74) in the leftward and rightward inward directions and have fitting and engaging parts for connection with the mounting member 80.

In addition, as illustrated FIG. 17A, gaps G are formed between the end faces of both the left and right edges 71A and 71B of the lumbar support main body 71 and the lateral frame member main bodies 74A and 74B (74), and the lumbar support main body 71 is connected by the protrusion parts 75.

Alternatively, as illustrated in FIG. 17B, without forming the gaps G between the end faces of the edges 71A and 71B of the lumbar support main body 71 and the lateral frame member main bodies 74A and 74B (74), mutual ends thereof may be configured to be in contact with each other.

The mounting member 80 is provided with a connecting part 81 that extends in the leftward/rightward direction and connects the left and right lateral frame members 73A and 73B (73) and a mounting part 85 that is connected in the middle of the connecting part 81 in the leftward/rightward direction, extends in the upward/downward direction, and is mounted on the backrest rear supporting member 40 via the connecting member 90.

The connecting part 81 has lateral frame member holding parts 82A and 82B (82) at both left and right ends thereof and is configured to hold the lateral frame members 73 by fitting the plug-in parts 77 of the lateral frame members 73 into the lateral frame member holding parts 82.

In addition, the mounting part 85 is formed with a connecting member mounting hole 85H that is penetrated in the forward/backward direction and extends in the upward/downward direction and corrugated parts 85A that curvilinearly repeat concavity and convexity at both left and right peripheries of the connecting member mounting hole 85H in the forward/backward direction.

As illustrated in FIGS. 13A, 13B, 14A, and 14B, in a state in which the lateral frame members 73 are fitted into the lateral frame member holding parts 82 and are integrated with the mounting member 80, an upper edge side of the lumbar support main body 71 is connected with the mounting member 80 via the left and right lateral frame members 73A and 73B (73), and the gap 70H is formed between the lateral frame member 73A and the lateral frame member 73B in the leftward/rightward direction of an upper edge of the lumbar support main body 71.

On the other hand, a lower edge side of the lumbar support main body 71 is supported via the lateral frame member main bodies 74A and 74B (74) with respect to the connecting part 81 of the mounting member 80 in a cantilever fashion, and the gap 70J is formed between the lumbar support main body 71 and the mounting member 80 including the left and right lateral frame members 73A and 73B (73) in the leftward/rightward direction.

The connecting member 90 is equipped with a positioning block 91, a mounting block 95, and fixing screws 90P. The connecting member 90 connects the lumbar support 70 to the backrest rear supporting member 40 and makes it possible to adjust a height of the lumbar support 70 in the upward/downward direction.

The positioning block 91 and the mounting block 95 are mounted to sandwich the mounting member 80 from the front and rear sides and are adapted to be fixed by the fixing screws 90P.

Figure 18A:
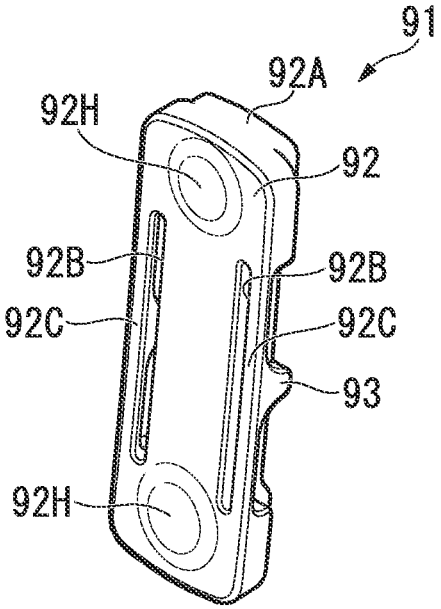
FIG. 18A is a view for describing details of principal parts of the lumbar support and the backrest according to the third embodiment of the present invention and is a perspective view when a cross section including a height adjusting mechanism is viewed from the oblique front side.
Figure 18B:
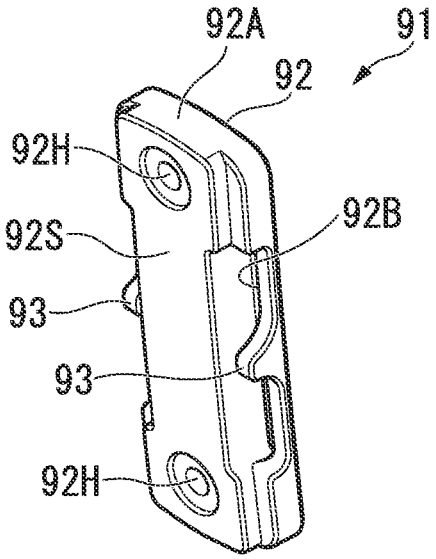
FIG. 18B is a view for describing details of principal parts of the lumbar support and the backrest according to the third embodiment of the present invention and is a perspective view when the cross section including the height adjusting mechanism is viewed from the oblique rear side.

As illustrated in FIGS. 18A and 18B, the positioning block 91 has a positioning block main body 92 whose rear middle side in the leftward/rightward direction in a cross section perpendicular to a longitudinal direction (upward/downward direction) protrudes, which is formed with a convex part 92S extending in the longitudinal direction, and in which two screw mounting holes 92H on which the fixing screws 90P are screwed are formed at an interval in the longitudinal direction.

In addition, the positioning block main body 92 has elongate holes 92B formed adjacent to both left and right edges thereof. Elastic deformation parts 92C are formed outside the elongate holes 92B in the width direction, and positioning convex parts 93 that protrude backward and are engaged with the corrugated parts 85A of the mounting member 80 are formed in the middles of the respective elastic deformation parts 92C in the longitudinal direction. The corrugated parts 85A and the positioning convex parts 93 constitute a height adjustment mechanism that slides and positions the lumbar support 70 in the upward/downward direction step by step.

Figure 21:
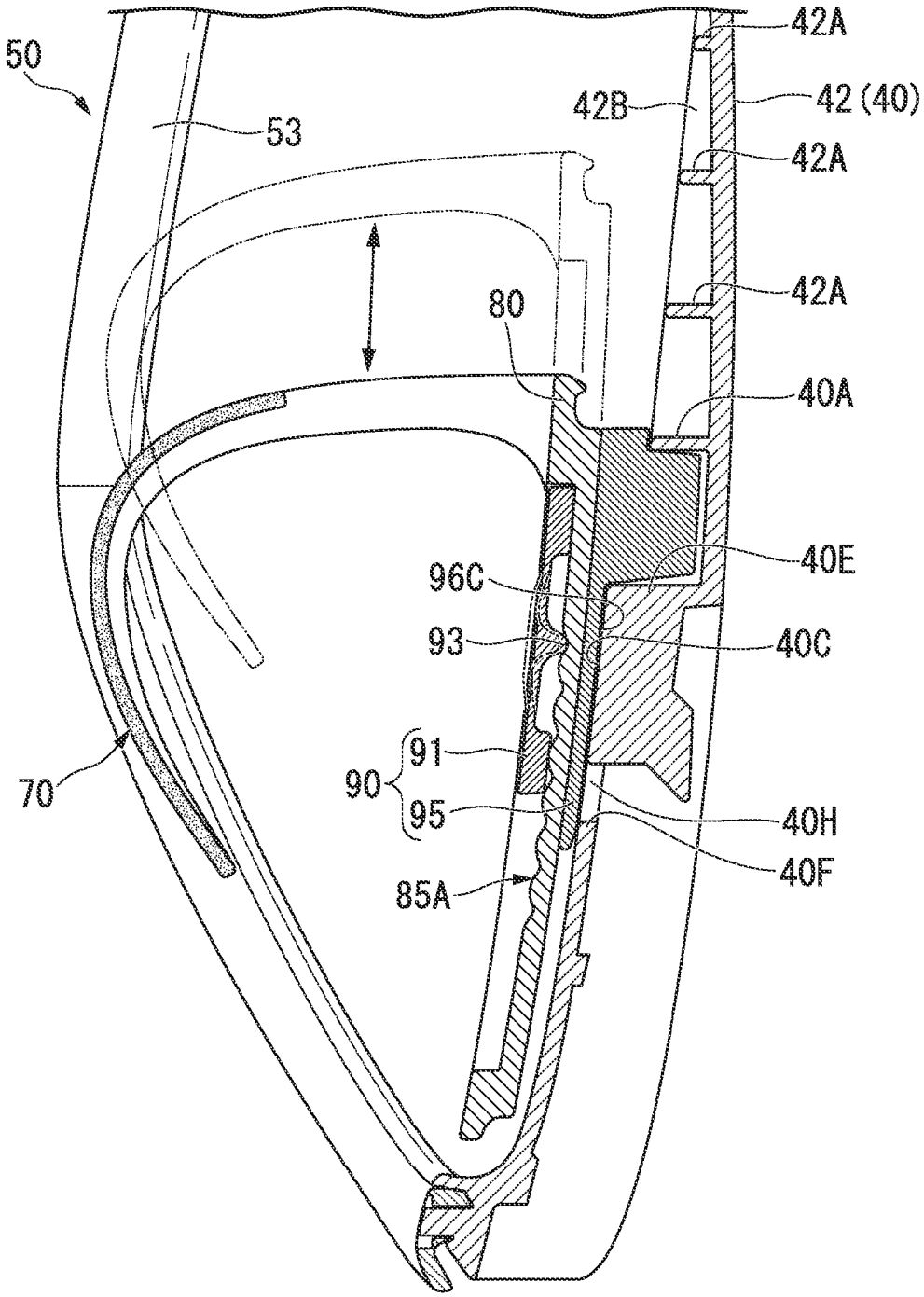
FIG. 21 is a view for describing details of principal parts of the lumbar support and the backrest according to the third embodiment of the present invention and is a partial sectional view when the middle cross section is viewed from the side.

According to the height adjustment mechanism, as illustrated in FIG. 21, when the lumbar support 70 is displaced along an arrow in the upward/downward direction, the positioning convex parts 93 are engaged with and locked in concave parts of the corrugated parts 85A, and height adjustment can be performed.

Figure 19A:
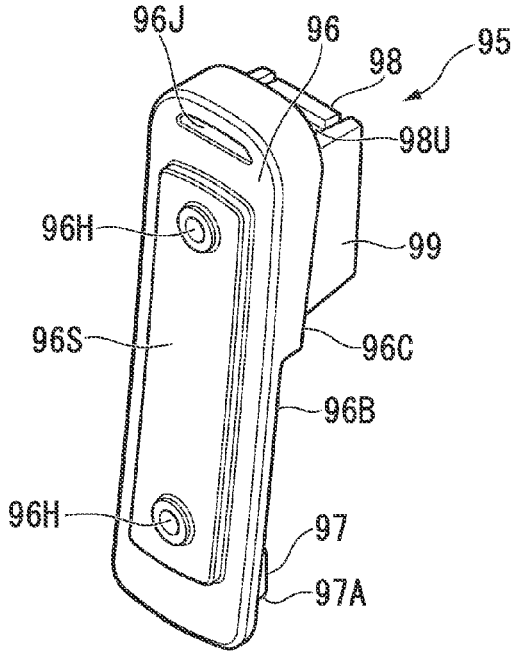
FIG. 19A is a view for describing details of principal parts of the lumbar support and the backrest according to the third embodiment of the present invention and is a perspective view when a middle cross section is viewed from the oblique front side.
Figure 19B:
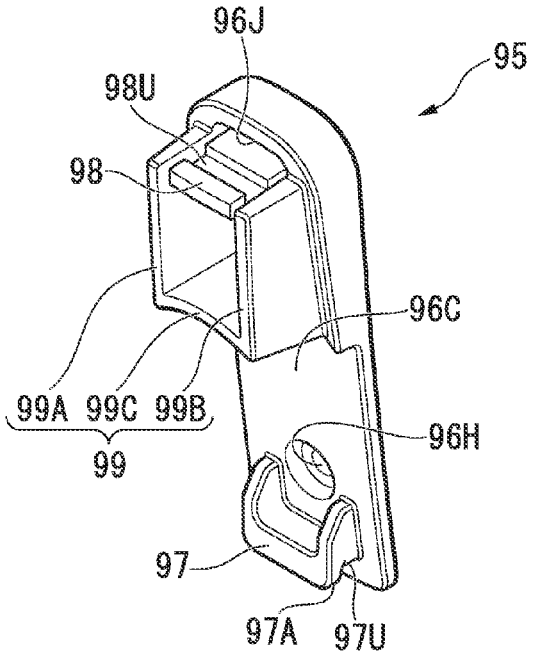
FIG. 19B is a view for describing details of principal parts of the lumbar support and the backrest according to the third embodiment of the present invention and is a perspective view when the middle cross section is viewed from the oblique rear side.

As illustrated in FIGS. 19A and 19B, the mounting block 95 has a mounting block main body 96 whose front middle side in the leftward/rightward direction in a cross section perpendicular to a longitudinal direction protrudes, which is formed with a convex part 96S extending in the longitudinal direction, and in which two through-holes 96H for giving passage to the fixing screws 90P are formed at an interval in the longitudinal direction.

The convex part 96S also comes into contact with the convex part 92S of the positioning block 91. Thereby, the positioning block 91 and the mounting block 95 are configured to secure position accuracy in a thickness direction thereof.

In addition, a first engaging wall part 97 is formed at a lower side of the mounting block main body 96 in the upward/downward direction. The first engaging wall part 97 protrudes backward from the mounting block main body 96 and constitutes a first engaging section. A tip portion of the first engaging wall part 97 is formed with a first engaging convex segment 97A protruding to a lower side (the opposite side of a second engaging section) and has a first engaging geometry part 97U that is open to the lower side and has an approximate U shape.

A tip of the first engaging convex segment 97A is also located above a lower end of the mounting block main body 96. That is, the lower end of the mounting block main body 96 is formed downward longer than the tip of the first engaging convex segment 97A.

A second engaging wall part 98 and a channel-like wall part 99 that protrude backward from the mounting block main body 96 constituting the second engaging section are also formed at an upper side (second position) of the mounting block main body 96 in the longitudinal direction, and a concave part 98U is formed at an upper side (the opposite side of the first engaging section) of the second engaging wall part 98. A release hole 96J for elastically deforming the second engaging wall part 98 from the outside is also formed at the upper side of the second engaging wall part 98.

In addition, the channel-like wall part 99 is formed at the lower side (the side of the first engaging wall part 97) of the mounting block main body 96 in the longitudinal direction with respect to the second engaging wall part 98 in a channel shape in which an upper side thereof is open when viewed from the rear. The channel-like wall part 99 has guide wall parts 99A and 99B disposed on the left and right of the second engaging wall part 98 and a lower guide wall part 99C disposed below the second engaging wall part 98.

As illustrated in FIGS. 10A and 10B, the lumbar support 70 equipped with the connecting member 90 having the above constitution can be easily connected to the backrest rear supporting member 40. Accordingly, the lumbar support 70 can be easily mounted and demounted even between the upholstering material 51 of the backrest 50 and the backrest rear supporting member 40.

Figure 20:
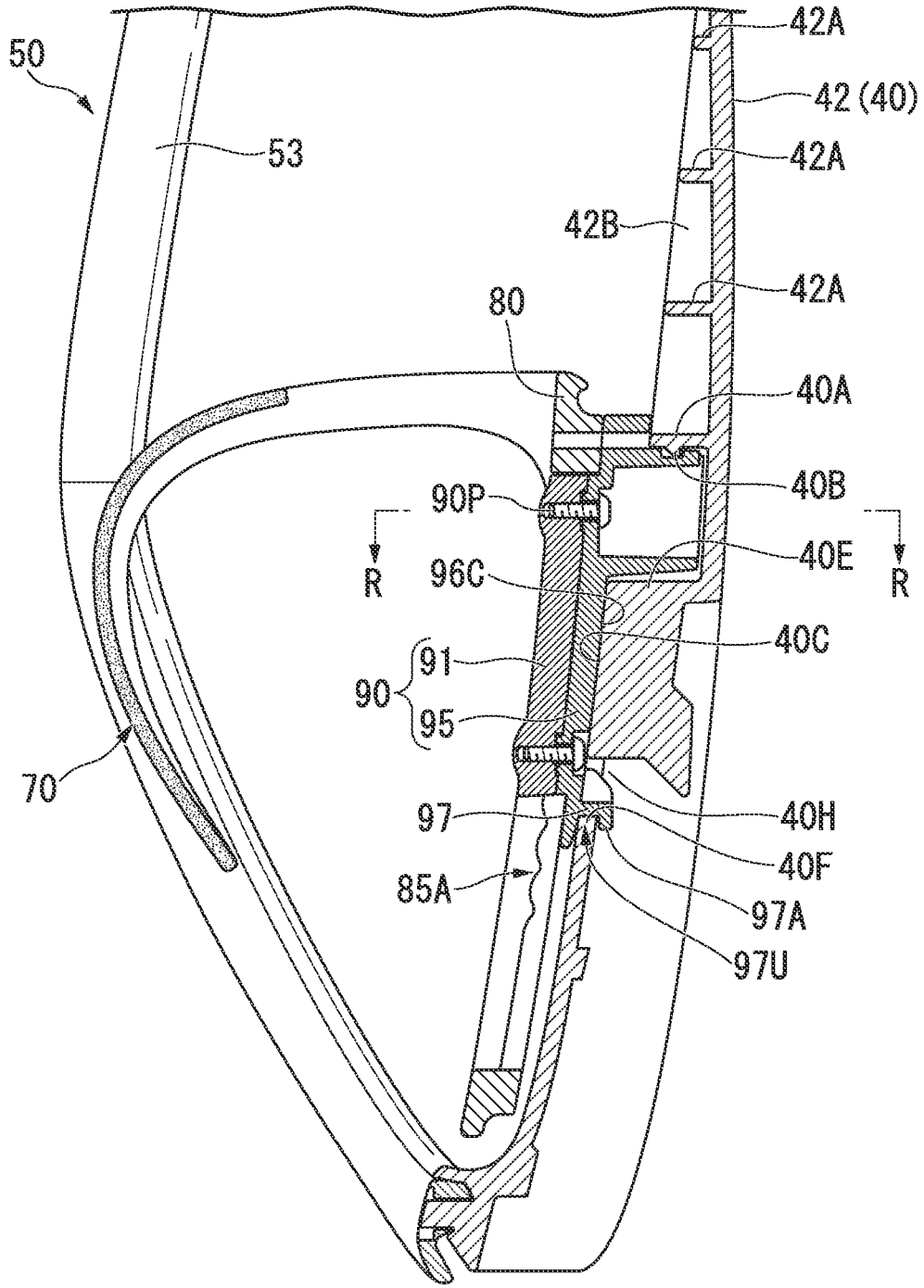
FIG. 20 is a view for describing details of principal parts of the lumbar support and the backrest according to the third embodiment of the present invention and is a partial sectional view when the cross section including the height adjusting mechanism is viewed from the side.
Figure 22:
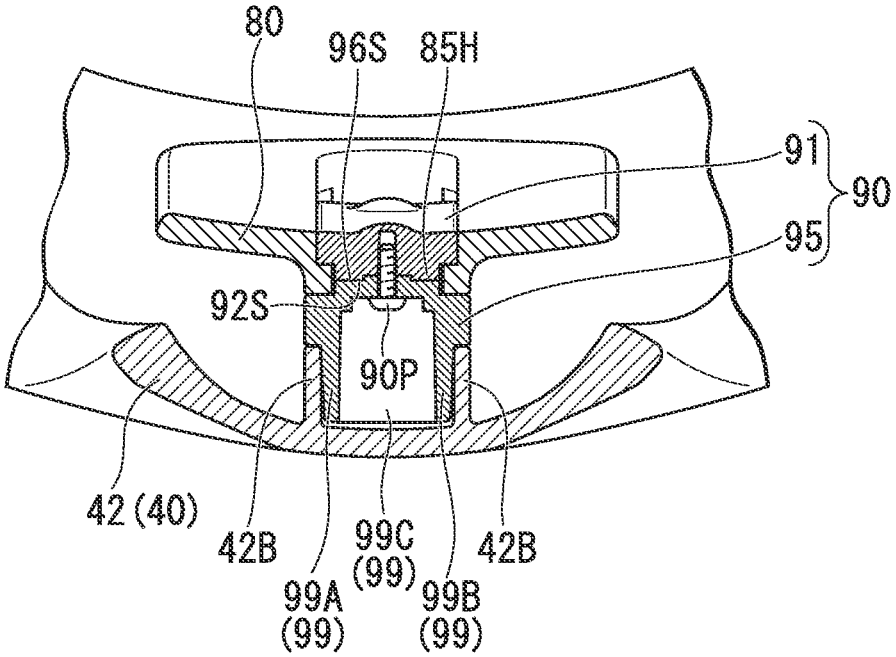
FIG. 22 is a view for describing details of principal parts of the lumbar support and the backrest according to the third embodiment of the present invention and is a cross sectional view in a cross section taken along line R-R of FIG. 20.

As illustrated in FIGS. 20 to 22, the first engaging wall part 97 is engaged with an end 40F of the backrest rear supporting member 40 which is located at a lower side of an engaging hole 40H formed in the backrest rear supporting member 40 at a position corresponding to the first engaging wall part 97, the engaging convex segment 97A formed at the first engaging wall part 97 is inserted into the engaging hole 40H, and the first engaging geometry part 97U comes into contact with the end 40F. Thereby, the first engaging section and a first engaged section are engaged. At this time, the lumbar support 70 and the backrest rear supporting member 40 are brought into contact by mutual facing surfaces 96C and 40C between the first engaging section and the second engaging section.

In addition, the second engaging wall part 98 is engaged with the engaging rib 40A that is formed at the backrest rear supporting member 40 and protrudes forward. A surface of an upper side of the second engaging wall part 98 (i.e., the opposite side of the first engaging section of the second engaging wall part 98) and a surface of a lower side of the engaging rib 40A are located to be face each other, the second engaging wall part 98 is elastically deformed downward, and a convex part 40B protruding downward from the middle of the engaging rib 40A is inserted into the concave part 98U. Thereby the second engaging section and a second engaged section are engaged.

Similarly, in the second engaged section, a housing wall part 40E protruding to an upper side at which the second engaging wall part 98 and the lower guide wall part 99C of the channel-like wall part 99 are housed in a circular arc shape are formed below the engaging rib 40A along with the engaging rib 40A and the longitudinal ribs 42B, and the second engaging wall part 98 and the lower guide wall part 99C of the channel-like wall part 99 are formed into a housing concave part defined by the engaging rib 40A, the longitudinal ribs 42B, and the housing wall part 40E. Thus, the lumbar support 70 is reliably connected to the backrest rear supporting member 40.

In a state in which the first engaging wall part 97 constituting the first engaging section is engaged with the first engaged section formed at the backrest rear supporting member 40 and is engaged with the end 40F of the first engaging wall part 97, the side of the second engaging section of the connecting member 90 is turned backward, and the second engaging wall part 98 constituting the second engaging section is turned toward the engaging rib 40A. Along with this, the second engaging wall part 98 is elastically deformed by the engaging rib 40A, and the second engaging wall part 98 is engaged with the second engaged section formed at the backrest rear supporting member 40. Thereby, the lumbar support 70 is connected to the backrest rear supporting member 40. In addition, in a state in which the first engaging wall part 97 and the second engaging wall part 98 are engaged with the first engaged section and the second engaged section, the first engaging wall part 97 is adapted to be supported by the side of the second engaging section, and the second engaging wall part 98 is adapted to be supported by the side of the first engaging section.

Since the lumbar support 70 is firmly supported by the backrest rear supporting member 40, even when the left and right vertical frame sections 53A and 53B (53) are deformed, the lumbar support 70 is rarely deformed compared to the vertical frame section 53. As a result, since a large amount of force is required for the elastic deformation, even when the user leans, the lumbar area of the user can be firmly supported.

Next, a description will be made with reference to an operation when a user sits on a seat section 30 of a chair 301 and leans on a backrest 50.

Figure 23A:
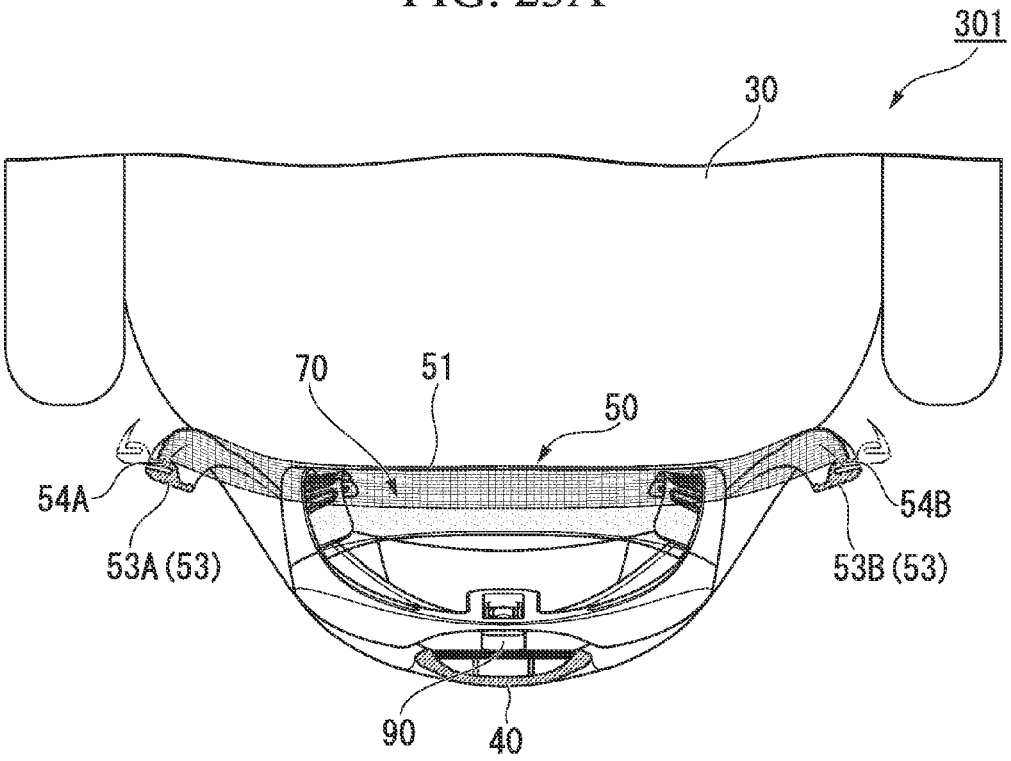
FIG. 23A is a view illustrating a cross section at an upper side of the lumbar support in a state in which the user sits down on the seat with regard to the chair according to the third embodiment of the present invention and is a view illustrating a state in which the user sits down on the seat forward.

As illustrated in FIG. 23A, when the user leans on the backrest 50, a force from the user is applied to an upholstering material 51 of the backrest 50. As the threads constituting a mesh of the upholstering material 51 are elastically expanded and contracted by this force, approximately the middle of the upholstering material 51 in the width direction is elastically deformed in a circular arc shape so as to protrude backward along the back of the user as a whole.

Due to a force applied from the upholstering material 51, vertical frame sections 53A and 53B to which the upholstering material 51 is fixed are also elastically deformed to direct inner sides thereof in the width direction to the rear side and move to the inner sides thereof in the width direction so as to come close to each other.

On the other hand, since the pair of vertical frame sections 53A and 53B connected to both ends of an upper frame section 52 in the width direction are elastically deformed by the force applied from the upholstering material 51, they can be deformed to conform the back of the user according to a load of the user and receive the back so as to wrap around the back along with the upholstering material 51, and a lumbar support 70 supports the lumbar area of the user at a rear side while being elastically deformed backward. For this reason, the user can sits down on the seat in a stable state.

Since the lumbar support 70 is firmly supported by a backrest rear supporting member 40, even when the left and right vertical frame sections 53A and 53B (53) are deformed, the lumbar support 70 is rarely deformed compared to the vertical frame section 53. As a result, since a large amount of force is required for the elastic deformation, even when the user leans, the lumbar area of the user can be firmly supported.

In addition, since upper materials 56A and 56B constituting the vertical frame sections 53A and 53B are elastically deformed by the force applied from the upholstering material 51, they can be deformed to conform the back of the user according to the load of the user and receive the back so as to wrap around the back along with the upholstering material 51.

Figure 23B:
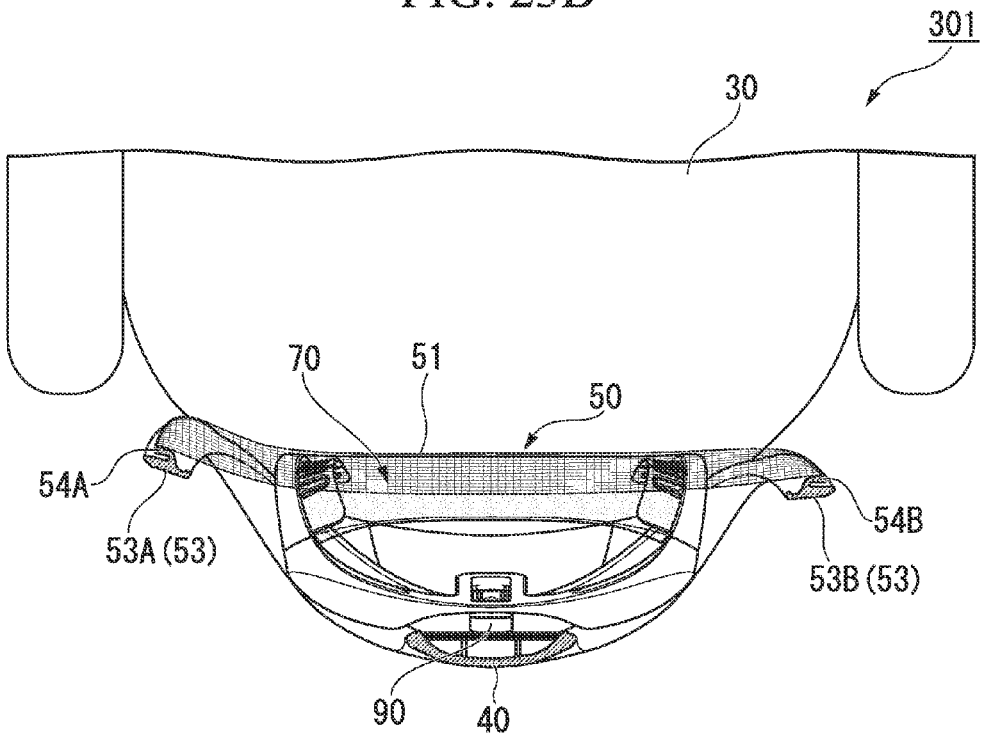
FIG. 23B is a view illustrating a cross section at the upper side of the lumbar support in the state in which the user sits down on the seat with regard to the chair according to the third embodiment of the present invention and is a view illustrating a state in which the user twists an upper portion of their back rightward and leans on the backrest.

As illustrated in FIG. 24B, when the user takes a posture of looking back from one side of the backrest 50 in the width direction to the rear side, the load from the user is biased and applied to the one side of the backrest 50 in the width direction as illustrated in FIGS. 23B and 24B, and a load causing twisting deformation of the vertical frame section 53B is applied to the vertical frame section 53B of the biased side.

Here, the upper material 56B in the vertical frame section 53B is configured to enable twisting deformation by the force applied from the backrest 50 or a connection segment 43B connected to the upper material 56B is configured to enable displacement along with the twist of the upper material 56B. Thus, the connection segment 43B is displaced to a rear lateral side along with the twist directed to a rear lateral side of the vertical frame section 53B.

The threads constituting the mesh of the upholstering material 51 are elastically expanded and contracted by the load from the user, and the upholstering material 51 in the backrest 50 is elastically deformed to wrap around the back of the user.

In addition, as the user leans, the upper and lower free edges of the lumbar support main body 71 of the lumbar support 70 are deformed, and the gaps 70H and 70J are reduced. Then, since the gaps 70H and 70J are reduced, the lumbar support main body 71 is deformed over the entire region in the upward/downward direction so as to wrap around the user in the leftward/rightward direction.

In the chair 301 configured in this way, when the user sits down on the seat , the lumbar support main body 71 can inhibit a sense of oppression from occurring at the lumbar area and properly support the lumbar area.

In addition, since the free edges of the lumbar support main body 71 which are deformable backward are formed up and down, a deformation tolerance of the lumbar support main body 71 is increased, and the lumbar support main body 71 is deformed over a wide range thereof in the upward/downward direction so as to enclose the middle thereof from both sides in the leftward/rightward direction.

As a result, when the user sits down on the seat , the lumbar support main body 71 is inhibited from coming into point contact with the lumbar area.

Also, the mounting member is equipped with the connecting part connecting both of the left and right lateral frame members, and the lateral frame members and the mounting member are integrally formed. Thus, the lateral frame members and the mounting member can be improved in strength, and the lumbar support main body can be stably deformed backward. The deformation tolerance of the lumbar support main body can be improved.

Alternatively, the lumbar support main body 71 may be configured such that, when the user sits down on the seat and the upholstering material 51 is deformed backward, a curvature of the upholstering material 51 is made greater than that of the lumbar support main body 71 such that the upholstering material 51 comes into contact with the lumbar support main body 71 ahead of the lateral frame members 73, or the lumbar support main body 71 bulges forward above an amount by which the upholstering material 51 bulges backward.

In addition, since the lateral frame members is equipped with the protrusion parts 75 locking both of the left and right edges of the lumbar support main body, the lumbar support main body and the lateral frame members can be easily connected and supported.

Also, since the plurality of protrusion parts 75 are formed at the lateral frame member main bodies 74 along the support geometry parts in correspondence to both of the left and right edges 71A and 71B of the lumbar support main body 71 and are put and locked in the lumbar support main body 71, they can connect the lumbar support main body 71 with a high degree of strength and furthermore sufficiently support the load applied to the lumbar support main body 71.

According to the lumbar support 70, since the protrusion part 71B that is put and locked in the lumbar support main body 71 is equipped with the perforated locking wall parts 75B having the through-holes 76U whose peripheries are closed, and since the wall parts 71G that are formed inside the lumbar support main body 71 and extend in the thickness direction pass through the through-holes 76U, the lumbar support main body 71 can be stably supported with a high degree of strength. Also, even when the wall parts 71G move inside the through-holes 76U, the lumbar support main body 71 can be inhibited from dropping out of the lateral frame members 73.

According to the lumbar support 70, since the protrusion parts 75 can be elastically deformed in an in-plane direction of the lumbar support main body 71, and since the support parts to which the lumbar support main body 71 and the lateral frame members 73 are connected are inhibited from being excessively hardened, an elastic deformation tolerance at each support part of the lumbar support main body 71 is increased, and a sufficient elastic deformation tolerance can be secured over a large range of a human body support surface of the lumbar support main body 71.

Also, since the lumbar support main body 71 is formed of the elastically deformable soft material such as the elastomer, a large degree of elastic deformation tolerance can be secured for the lumbar support main body 71, and sufficient flexibility can be secured for the human body support surface.

According to the lumbar support 70, since high elastic deformation in the in-plane direction is easily obtained from the lumbar support main body 71, and since the lumbar support 70 is elastically deformed along the support geometry parts of the lateral frame members 73 corresponding to the bulging portions thereof, a large degree of elastic deformation tolerance can be secured within a large range of the lumbar support main body 71, and a human body can be flexibly supported over a large range of the human body support surface.

In addition, the movement procedures shown in the aforementioned embodiments or all the shapes or combinations of constituent members are only examples and can be variously modified based on design requirements without departing from the spirit and scope of the present invention.

In the aforementioned embodiments, the upper materials 56A and 56B of the vertical frame sections 53A and 53B are configured to enable the twisting deformation depending on the force applied from the upholstering material 51. However, both the upper materials 56A and 56B and the lower materials 57A and 57B may be configured to enable the twisting deformation depending on the force applied from the upholstering material 51.

In this constitution, since the twisting deformation is possible in the upward/downward direction of the vertical frame sections 53A and 53B, when the user takes the posture of looking back from the one side in the width direction to the rear side, the user can be twisted corresponding to the deformation of their back from the lower portions of the vertical frame sections 53A and 53B. Accordingly, even though the user takes a posture of greatly looking back to the rear side, the user can be conformed and supported depending on the deformation of their back.

The vertical frame sections 53A and 53B may also be configured to enable gradual twisting deformation toward the upper side from the lower side depending on the force applied from the upholstering material 51.

In this constitution, when the user takes the posture of looking back from the one side in the width direction to the rear side, their back is deformed to be gradually greatly twisted toward the upper side from the lower side and, correspondingly, the vertical frame sections 53A and 53B can also be gradually greatly twisted toward the upper side from the lower side. Accordingly, the vertical frame sections 53A and 53B can be deformed reliably corresponding to the deformation of the back of the user, and thus they can conform the back of the user in the upward/downward direction and more stably support the back of the user along with the backrest.

The vertical frame sections 53A and 53B may also be configured to disable the elastic deformation depending on the force applied from the upholstering material 51.

In this constitution, the constitutions of the vertical frame sections 53A and 53B are simplified, and when the user takes the posture of looking back from the one side in the width direction to the rear side, the vertical frame sections 53A and 53B can be subjected to the twisting deformation and incline the backrest 50 backward.

For example, in the embodiments represented above, the backrest rear supporting member 40 and the backrest 50 are integrally formed. However, the backrest rear supporting member 40 and the backrest 50 may also be used as separate members.

INDUSTRIAL APPLICABILITY

The present invention provides a chair capable of reliably supporting the back of a user and, when the user takes a posture of looking back from one side in a width direction to a rear side, conforming a change in the user's position, and also further capable of supporting a load of the user, being deformed by conforming the back of the user and, when the user reclines their back backward, conforming the motion.

REFERENCE SIGNS LIST

1, 201, 301 . . . chair
10 . . . leg body
20 . . . backrest supporting body
40 . . . backrest rear supporting member
41 . . . lower connection section
43 . . . upper connection section
43A, 43B . . . pair of connection segments
50 . . . backrest
51 . . . upholstering material
52 . . . upper frame section
53A, 53B (53) . . . vertical frame section
56A, 56B (56) . . . upper material
57A, 57B (57) . . . lower material
61 . . . first annular section
62 . . . second annular section
42, 242 . . . deformable section

The invention claimed is:

1. A chair comprising:
a leg body;
a backrest supporting body supported by the leg body;
a backrest rear supporting member supported by the backrest supporting body; and
a backrest supported by the backrest rear supporting member and configured to support a back of a user,
wherein the backrest has:
a flexible upholstering material configured to receive the back of the user and deform along the back of the user; and
a pair of vertical frame sections that are mounted on the upholstering material, have lower ends connected to the back rest rear supporting member, and are separated in a width direction and twistingly deform depending on a load applied from the back of the user;
wherein,
the backrest rear supporting member has:
a lower connection section that is connected to the backrest supporting body;
a deformable section that extends upward from the lower connection section and enables elastic deformation according to a load applied from the back of the user to the backrest, a horizontal cross section of the deformable section having a laterally-facing U-shape with a concave front surface and a convex rear surface; and
on the concave front surface of the deformable section, at least one transverse rib that protrudes forward and extends in an approximately horizontal direction, and at least one longitudinal rib that protrudes forward and extends in an approximately vertical direction.

2. The chair according to claim 1, wherein the backrest rear supporting member has a pair of connection segments that are mutually separated outward from the middle in the width direction toward an upper side from a lower side, have upper ends connected to the pair of vertical frame sections, and enable displacement along with twist of the vertical frame sections.

3. The chair according to claim 1 wherein the pair of vertical frame sections each have a lower material that is inclined relative to the horizontal toward an upper side of the vertical frame sections, and an upper material that is connected to the lower material and enables twisting deformation responsive to a force applied from the back of the user.

4. The chair according claim 1 wherein the vertical frame sections are curved and have a forwardly convex shape.

5. The chair according to claim 1, wherein:
the backrest has an upper frame section on which the upholstering material is mounted and which is connected with the backrest rear supporting member; and
the pair of vertical frame sections, which are connected to both ends of the upper frame section in the width direction and on which the upholstering material is mounted, elastically deform as a function of force applied from the upholstering material.

6. The chair according to claim 5, wherein the vertical frame sections each have a lower material and an upper material that is connected to an upper end of the lower material and enables elastic deformation with the force applied from the upholstering material.

7. The chair according to claim 6, wherein the lower material is formed to be gradually inclined forward toward an upper side of the vertical frame sections.

8. The chair according to claim 5 wherein the vertical frame sections are curved and have a forwardly convex shape.

9. The chair according claim 5 wherein the backrest rear supporting member is curved and has a forwardly convex shape.

10. The chair according to claim 5 wherein the backrest rear supporting member has upper connection sections that are disposed to be gradually widened outside in the width direction toward the upper side and support both ends of the upper frame section in the width direction.

11. The chair according to claim 5, wherein the backrest rear supporting member and the vertical frame section are integrally formed in an annular shape when viewed from the side.

12. The chair according to claim 10, wherein:

the upper connection sections are formed in a V shape so as to be separated from each other toward the upper side from an upper end of the deformable section and are configured as a pair of connection segments having upper ends connected to the vertical frame section;

the lower connection section, the deformable section, one of the pair of connection segments, and one of the pair of vertical frame sections constitute a first annular section having an annular shape when viewed from the side;

the lower connection section, the deformable section, the other of the pair of connection segments, and the other of the pair of vertical frame sections constitute a second annular section having an annular shape when viewed from the side; and the first annular section and the second annular section are connected by the lower connection section and the deformable section and are integrally formed.

13. The chair according to claim 12, wherein the backrest rear supporting member has:

the lower connection section that is connected to the backrest supporting body;

the deformable section that extends upward from the lower connection section and enables elastic deformation according to a load applied from the back of the user to the backrest; and an upper connection section that extends upward from an upper end of the deformable section and is connected with the backrest at an upper end thereof.

14. The chair according to claim 13, wherein the upper connection section is formed to be gradually inclined forward toward an upper side.

15. The chair according to claim 13 wherein the upper connection section has a pair of connection segments that are connected with the deformable section at lower ends thereof, are formed in a V shape so as to be separated from each other toward the upper side, and have upper ends connected to the backrest.

16. The chair according to claim 13 wherein the backrest has:

a lower material whose lower end is connected to the lower connection section and which is formed to be gradually inclined forward toward the upper side; and an upper material that is connected to the upper connection section at an upper end thereof.

17. The chair according to claim 16, wherein the backrest has the flexible upholstering material whose lower portion is connected to the lower material, whose upper portion is connected to the upper material, which receives the back of the user, and which enables deformation depending on the back.

* * * * *